US010548438B2

(12) United States Patent
Dunn et al.

(10) Patent No.: US 10,548,438 B2
(45) Date of Patent: Feb. 4, 2020

(54) WET WIPE CONTAINER WITH SPRAY PUMP DISPENSER

(71) Applicant: MUNCHKIN, INC., Van Nuys, CA (US)

(72) Inventors: Steven Bryan Dunn, Beverly Hills, CA (US); Nicholas Trumbo, La Canada, CA (US); Mark A. Hatherill, Beverly Hills, CA (US); Mark Gerard Tebbe, Ventura, CA (US)

(73) Assignee: MUNCHKIN INC., Van Nuys, CA (US)

( * ) Notice: Subject to any disclaimer, the term of this patent is extended or adjusted under 35 U.S.C. 154(b) by 0 days.

(21) Appl. No.: 14/541,499

(22) Filed: Nov. 14, 2014

(65) Prior Publication Data

US 2015/0173573 A1 Jun. 25, 2015

Related U.S. Application Data

(60) Provisional application No. 61/918,621, filed on Dec. 19, 2013.

(51) Int. Cl.

| | |
|---|---|
| ***B65D 43/16*** | (2006.01) |
| ***A47K 10/42*** | (2006.01) |
| ***B65D 83/08*** | (2006.01) |
| *A47K 10/32* | (2006.01) |

(52) U.S. Cl.

CPC ..... *A47K 10/421* (2013.01); *B65D 43/16* (2013.01); *B65D 83/0805* (2013.01); *A47K 2010/3266* (2013.01)

(58) Field of Classification Search

CPC ..... A47K 10/32; A47K 2010/328; A47K 10/3293

USPC ..... 221/135, 96, 150 A

See application file for complete search history.

(56) References Cited

U.S. PATENT DOCUMENTS

| | | | | |
|---|---|---|---|---|
| 3,980,203 | A * | 9/1976 | Dearling | A47K 10/32 221/96 |
| 4,598,664 | A * | 7/1986 | Hamlin | A47K 10/32 118/32 |
| 4,667,846 | A * | 5/1987 | Marceau | A47K 10/32 221/34 |
| 5,265,509 | A * | 11/1993 | Chen | A47K 10/32 83/282 |
| 6,457,434 | B1 * | 10/2002 | Lazar | A47K 10/32 118/314 |
| 6,601,737 | B1 * | 8/2003 | Sandler | A45D 34/06 206/229 |
| 6,847,011 | B2 * | 1/2005 | McConnell | A47K 10/421 219/386 |
| 7,018,473 | B2 * | 3/2006 | Shadrach, III | A47K 10/3818 118/315 |
| 7,497,351 | B2 * | 3/2009 | Amundson | A47K 10/421 221/135 |

(Continued)

*Primary Examiner* — Patrick H Mackey

(74) *Attorney, Agent, or Firm* — Robert Z. Evora, Esq.

(57) ABSTRACT

A wet wipe container having a housing having an internal compartment for holding wet wipes, a lid and a moisturizing spray dispenser. The lid has a dispensing opening through which wipes are dispensed and a dispensing opening lid for covering the dispensing opening while not in use. The moisturizing spray dispenser has an outlet positioned to dispense fluid directly onto the wet wipes in a storage position in the housing.

20 Claims, 20 Drawing Sheets

(56) References Cited

U.S. PATENT DOCUMENTS

| | | | | |
|---|---|---|---|---|
| 7,850,041 | B2 * | 12/2010 | Amundson | A47K 10/421 221/135 |
| 9,101,250 | B2 * | 8/2015 | Ray | A47K 10/24 |
| 2009/0031952 | A1 * | 2/2009 | Lazar | A47K 10/32 118/695 |
| 2010/0032443 | A1 * | 2/2010 | Mueller | A45D 34/00 221/2 |

* cited by examiner

FIG. 8
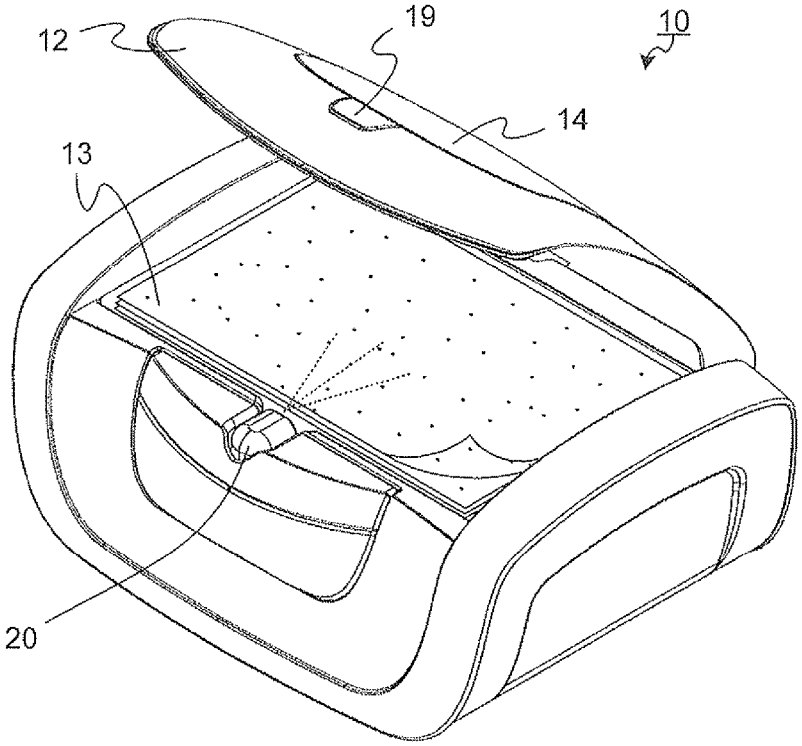
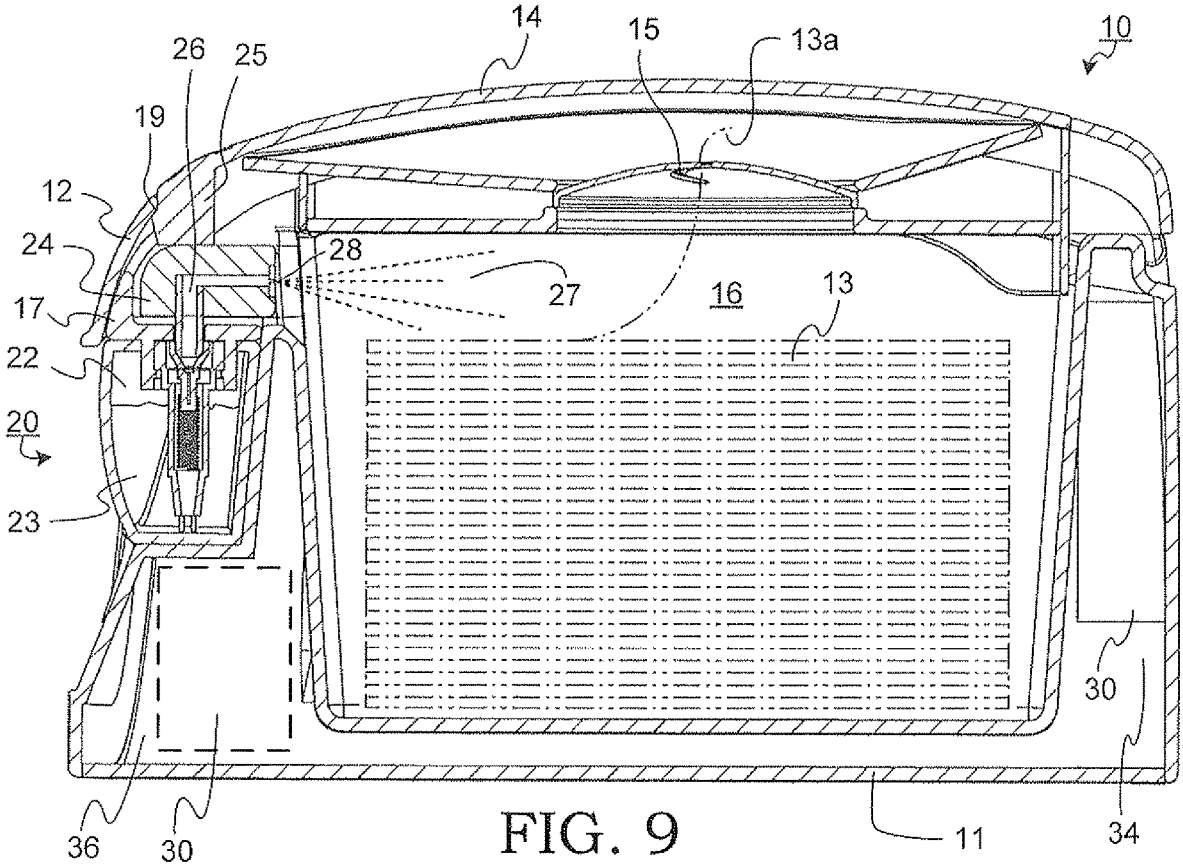
FIG. 9

WET WIPE CONTAINER WITH SPRAY PUMP DISPENSER

CROSS REFERENCE TO RELATED APPLICATION

This application claims priority to U.S. Provisional Application Ser. No. 61/918,621 filed Dec. 19, 2013; the contents of all of which are hereby incorporated by reference herein in their entirety into this disclosure.

TECHNICAL FIELD

The subject disclosure relates to baby wipe warmers, and in particular to a baby wipe warmer having a fluid pump dispenser adapted to provide moisture to the wipes for maintaining moisture and to prevent discoloration of the wipes.

BACKGROUND

Conventional baby wipe warmers store small pre-moistened paper or synthetic (non-woven) towelettes within a wipe warmer housing. The wipes are primarily used to cleanse and/or moisturize the skin of infants, small children and the like. Various moisteners, such as cleansers, lotions and preservatives are supplied to moisten the wipes after a towelette has been removed from its container. Numerous warming devices are available to provide warmth to the wipe to comfort the infant instead of applying a cold wet wipe to the skin of the infant.

Many of these warming elements are electrically operated. However, adding the warmth to the wipe container inherently affects the intended use of the wipe warmer and the wipes contained therein, in that the heat causes the moisture in the wipes to evaporate. Heating the wipes also causes an undesirable discoloration to the wipe.

Thus, there is a long-standing need to have a wipe warmer configured to effectively address these needs.

BRIEF DESCRIPTION OF THE DRAWINGS

Various exemplary embodiments of this disclosure will be described in detail, wherein like reference numerals refer to identical or similar components or steps, with reference to the following figures, wherein:

FIG. 8 illustrates an upper perspective view of another exemplary wet wipe container according to the subject disclosure.

FIG. 9 is a cross section view about C-C in FIG. 9 showing a second embodiment for actuating the pump mechanism in the wet wipe container.

DETAILED DESCRIPTION

Figure 1:
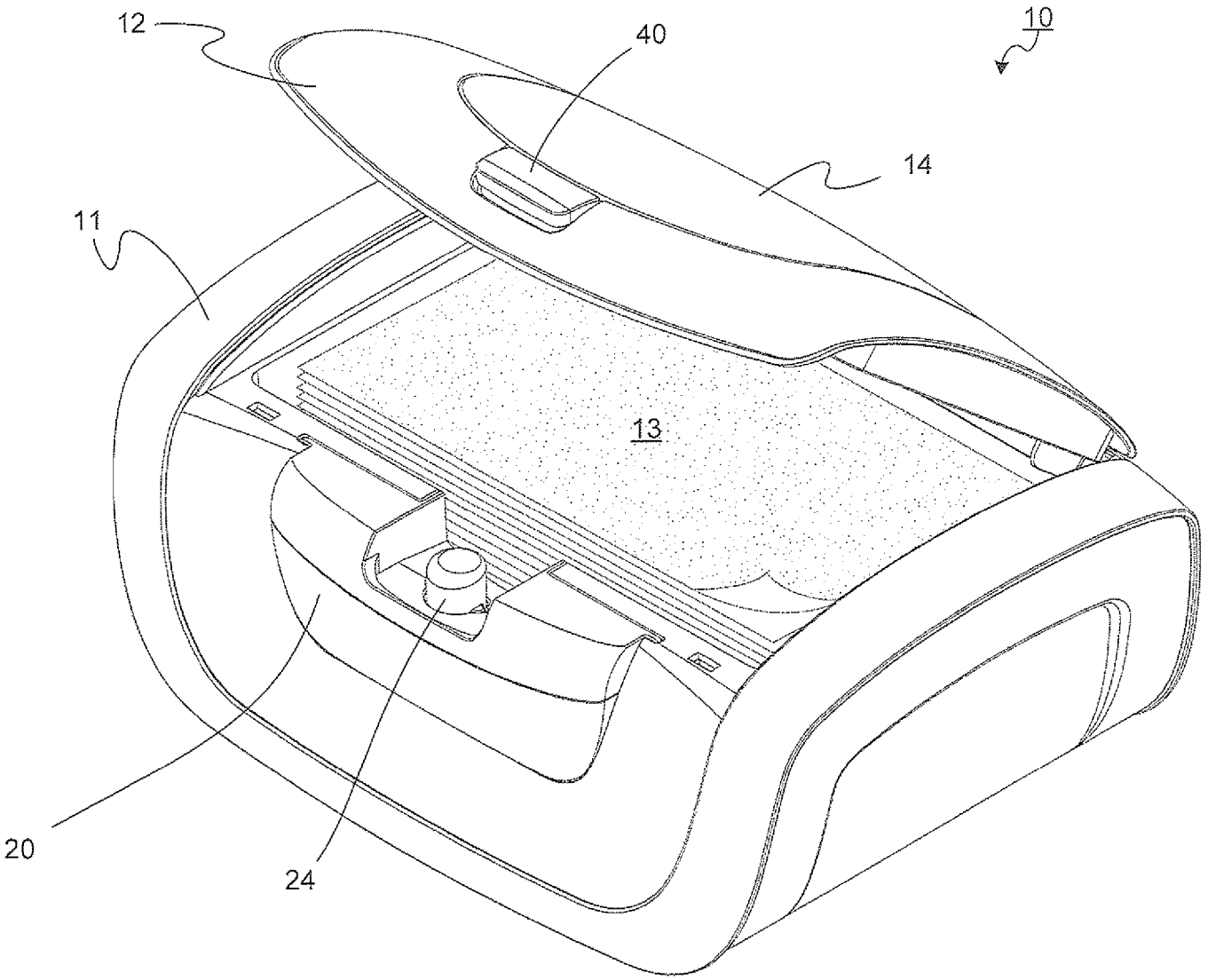
FIG. 1 illustrates an upper perspective view of an exemplary wet wipe container having a spray pump mechanism, a housing, a lid and a wipe access door according to the subject disclosure.

Particular embodiments of the present invention will now be described in greater detail with reference to the figures various, and not for purposes of limiting the same.

FIGS. 1-6 show a first configuration for a wet wipe container 10. As shown, the wet wipe container 10 is adapted to warm and/or moisturize a stack of wipes 13 within a housing 11. The wet wipe container 10 may comprise a housing 11, a lid 12, a wipe access door 14 and a spray pump mechanism 20. It is to be understood that the wet wipe container 10 may be formed to have a variety of housing shapes, configurations, geometries, sizes and textures in addition to that shown in the provided in the figures.

Figure 2:
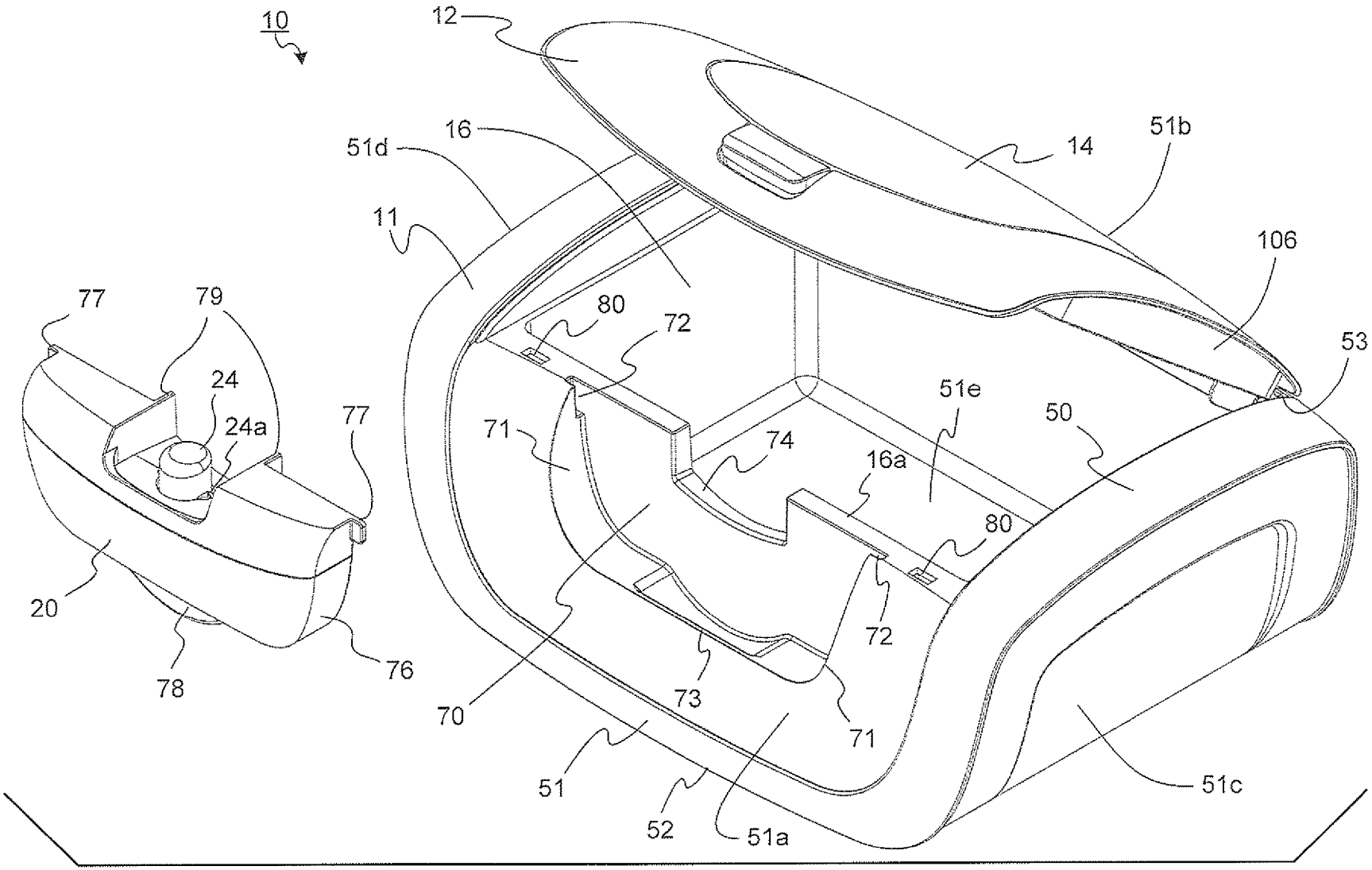
FIG. 2 depicts an exploded view of the wet wipe container.

FIG. 2 depicts an exploded view of the wet wipe container 10. The wet wipe container 10 may be fabricated from any rigid material, such as a plastic polymer, a metal and/or any other suitable material composition.

The housing 11 is constructed to have a lower closed end and an open upper end with the lid 12 pivotally attached to cover the open upper end. The container housing 11 is formed of a main body member 50, a base member 54 and the lid 12. The body member 50 is peripherally formed by various exterior-side housing walls, e.g., a front wall 51*a*, a rear wall 51*b*, a first side wall 51*c*, a second side wall 51*d* and a base wall 51*e*. A lower base end 52 of the various external housing walls 51*a*-51*d* are attached to the base wall 51*e*. The shape of the wet wipe container 10 may be contoured to take various shapes. As shown in the figures, the body member 50 may have smooth curved sides and edges.

Figure 5:
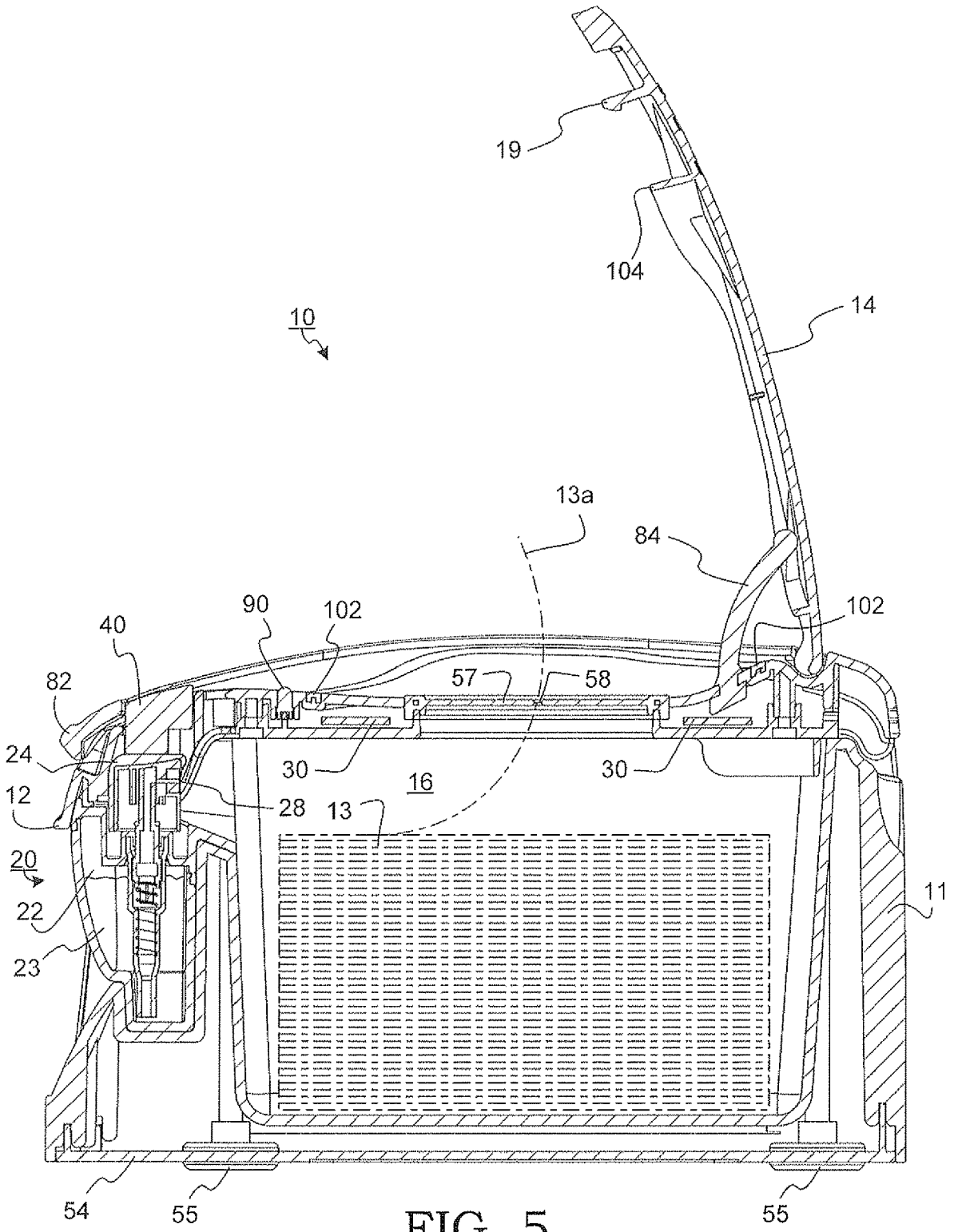
FIG. 5 is a cross section view about A-A in FIG. 4 showing a first embodiment for actuating the pump mechanism in the wet wipe container.
Figure 6:
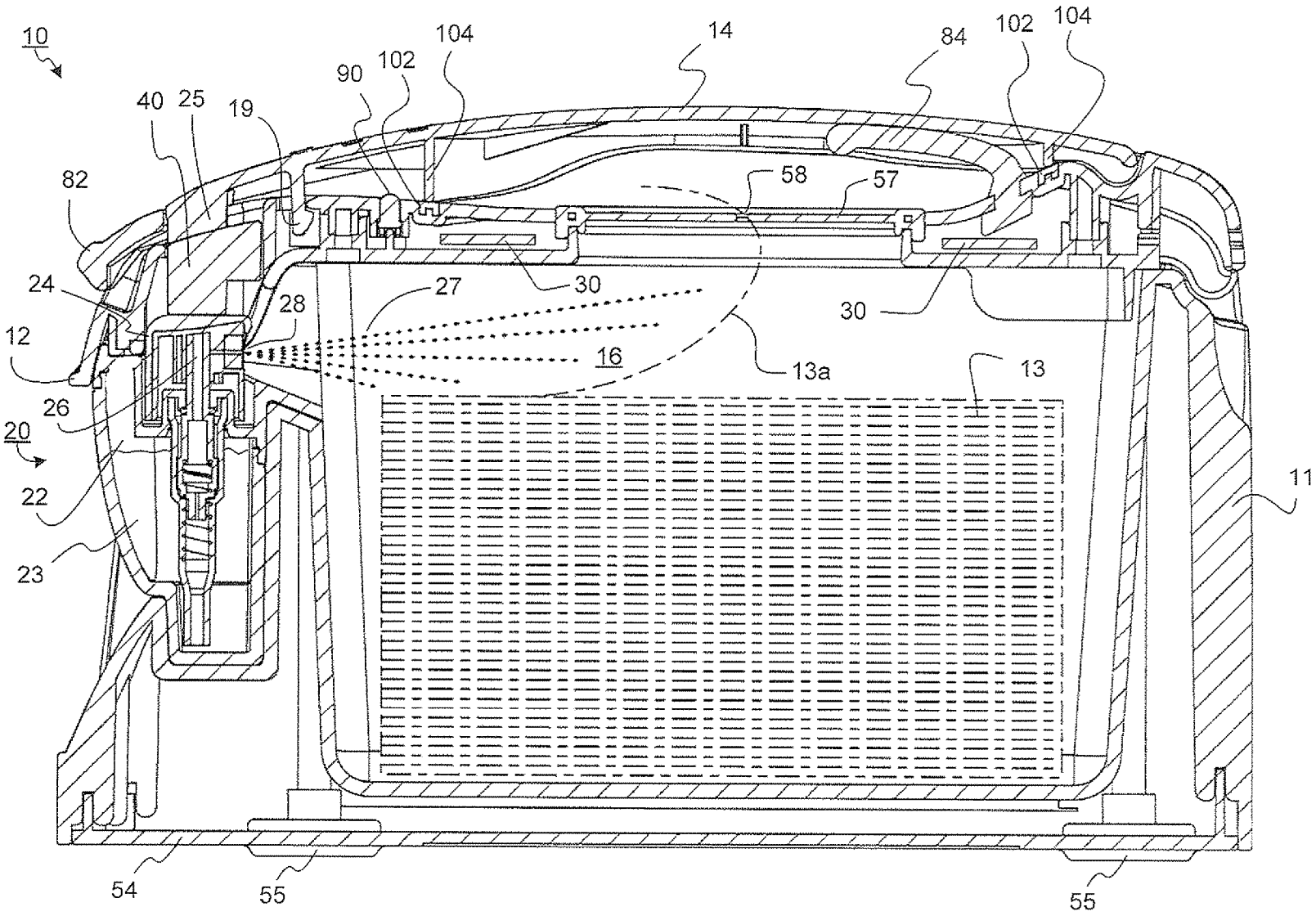
FIG. 6 depicts a cross section view about B-B in FIG. 3 of the wet wipe container.

The base member 54 supports the wet wipe container 10 on a surface (e.g., a desktop, a floor, a night stand, etc.). A pad or plurality of adjustable foot pads (as shown in FIGS. 5-6) may be adapted for use on a lower surface of the base member 54.

The housing 11 defines an inside compartment 16 to hold the stack of wipes 13. The shape of the inside compartment 16 may be substantially similar to the shape of the stack of wipes 13.

A spray pump recess 70 may be integrated into one of the walls of the housing 11. The spray pump recess 70 is adapted to receive and secure the spray pump mechanism 20 for wetting and/or providing a moisturizer directly onto the stack of wipes 13 while the stack of wipes 13 are contained in their storage position within the inside compartment 16 of the housing 11. Alternatively, the spray pump mechanism 20 may be located outside of the housing 11 with an outlet for providing moisture directly onto the stack of wipes 13, as will be described in greater detail below.

An inner front wall 16*a* is provided slightly inset from the front wall 51*a*. The inner front wall 16*a* being a part of the internal wipe housing compartment 16 separates the stack of wipes 13 from the spray pump mechanism 20. It is to be understood that the spray pump mechanism 20 may also be located in the housing 11 at any location which would allow for the spraying of the stack of wipes 13. That is, the spray pump mechanism 20 can also be located in any of the side walls of the wipe compartment 16, lid 12, base wall 51*e*, or externally adjacent to the housing 11.

The recess 70 may include a number of alignment features to facilitate positioning and securing of the spray pump mechanism 20. The recess 70 may have tracks 72 which may be recessed to slidingly receive protruding outer edges 77 of the spray pump mechanism 20. The recess 70 may also include a lower lip 73 which retains a bottom surface 78 of the spray pump mechanism 20, preventing it from laterally moving relative to the housing 11. The front wall 16*a* of the inner compartment 16 may also include an inwardly recessed portion 74, upon which rests an outwardly projecting ledge 79 on the spray pump mechanism 20. The tracks 72, the lower lip 73, and recessed portion 74, as well as a concave surface 71 of the recess 70 and complimentary convex surface 76 on the spray pump mechanism 20 all facilitate the aligning of the mechanism 20 as it is slides into secure positioning within the housing 11.

An advantage of having the spray pump mechanism 20 securely positioned and held within the housing 11 is to allow a user to spray a fluid in the spray pump mechanism 20 directly onto the stack of wipes 13 while the lid 12 is in a closed position, as will be discussed in greater detail below.

The wet wipe container 10 includes the pivotally engaged top lid 12. The lid 12 is capable of opening and closing relative to the housing 11 in order to access the wipes 13 within the internal wipe housing compartment 16 within the housing 11 and to load a new stack of wipes 13. Here, the lid 12 may pivot about a hinge 53 in the exterior-side housing wall 51 and rotate between an open and closed position. When in the closed position, the lid member 12 is held in place by a first securing mechanism, such as latching protrusions (not shown) extending from an underside of the lid member 12 which snap-fit into receiving grooves 80 provided on an upper side of the front wall 51*a* in the housing 11. The lid member 12 may open and close utilizing any conventional method such as using a door spring, for example.

The lid member 12 may include a resilient lid seal 106. The material used may be a plastic polymer, rubber, etc. and/or any other suitable material to form an air-tight seal. The lid seal 106 rests against the upper edges of the inside compartment 16 such that the lid seal 106 is slightly deformed to prevent fluid communication of air and/or moisture from the inside compartment 16 and the environment. This helps prevent the stack of wipes 13 from drying or browning.

As shown in FIG. 6, the lid seal 106 may also rest abuttingly against the spray pump mechanism 20, such that the outlet 28 is held within the air-tight seal and in fluid communication with the inside compartment 16. In this way, the outlet 28 may spray fluid from the spray pump mechanism 20 directly onto the stack of wipes 13 while the inside compartment 16 remains sealed from the outside environment.

The resilient lid seal 106 may be over-molded onto the lid 12 with various materials which, for example, may include thermoplastic polyurethane (TPU) or thermoplastic polyesters (TPE), polyolefin Elastomers (POE). Other commercially available materials may include Engage, Sarlink, Texin, Desmopan, Dynaflex, Versalloy, Versaflex and Elastolan. It should be noted that some or all of the above commercially available materials may be trademarks of the companies' manufacturing and/or selling the materials.

Figure 3:
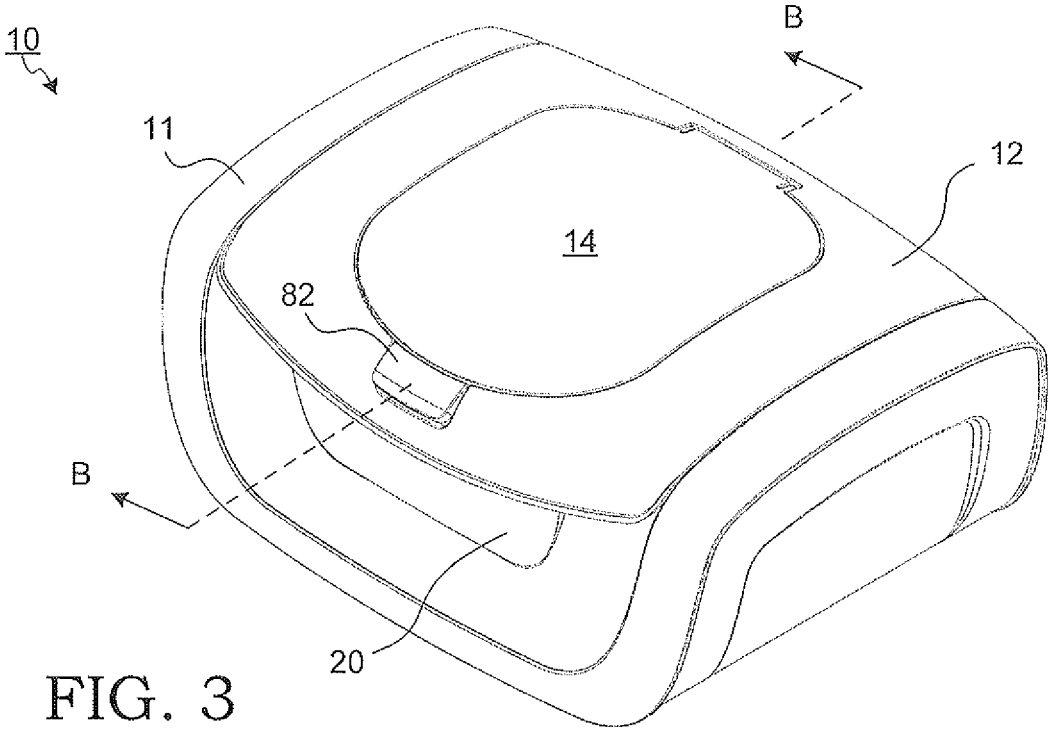
FIG. 3 shows the wet wipe container having a wipe access door in a closed position.

FIG. 3 shows the lid member 12 in a closed position. When the lid member 12 is closed, it partially becomes an upper housing wall as it partially encloses the open end of the internal wipe housing compartment 16 in the interior of the housing 11 from the outside. Opening the lid member 12 allows access to the inside compartment 16 of the housing 11 to refill a stack of wipes 13 (layered or inter-folded stack) to be individually withdrawn for use through a wipes access opening or dispensing opening 15 provided below a dispensing lid or wipes access door 14, as shown in FIG. 4.

Figure 4:
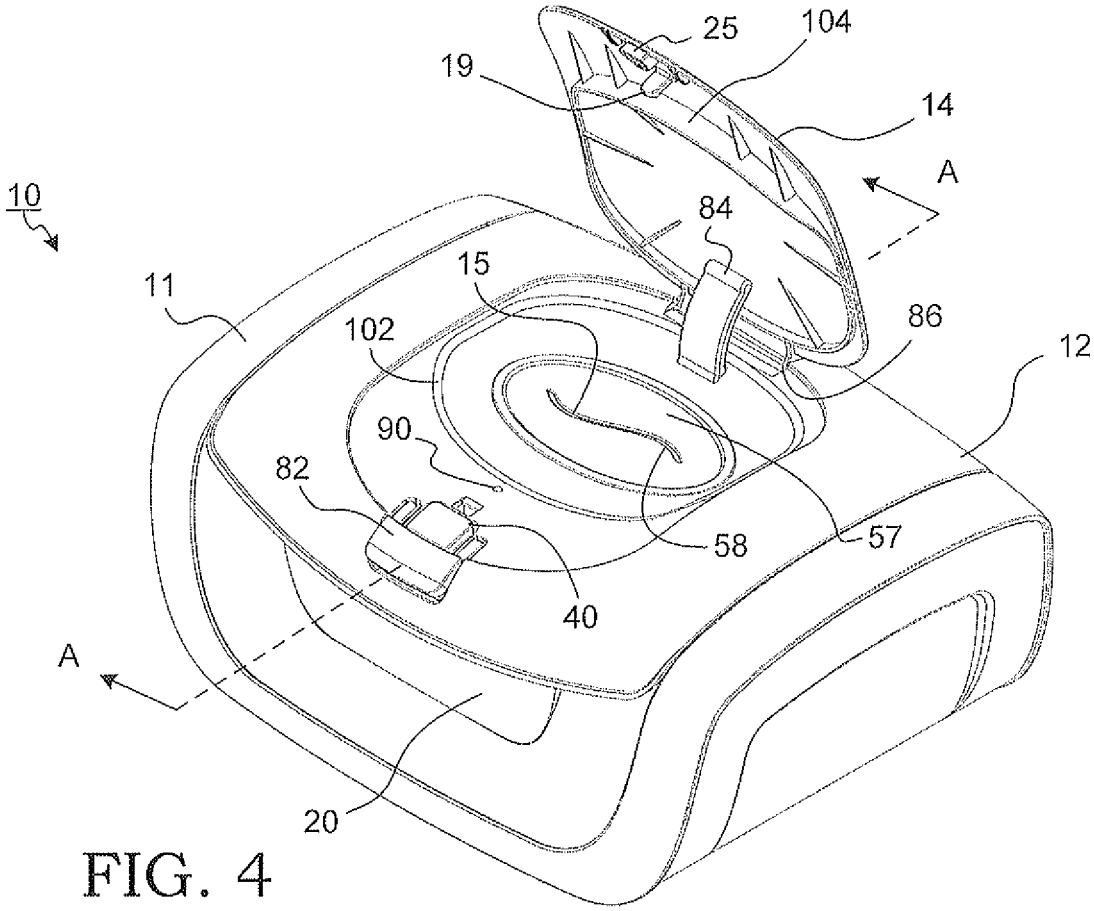
FIG. 4 illustrates the wet wipe container with the wipe access door in an open position.

FIG. 4 illustrates the wipe access door 14 in an open position. The wipes access door 14 pivots open about the lid 12. The wipes access door 14 pivots independently about a separate access door hinge 86 relative to the hinge 53 of the lid 12. In an open position, a user can access a wipe 13 and pull it through the wipe access opening 15 provided below the wipes access door 14. The wipes access door 14 is secured closed by a second securing mechanism, such as a second latch 19 as shown in FIG. 5. The first or second securing mechanisms may be configured as a releasable connection, such as with a releasably locking push-button latch 82, a snap lock, a latching mechanism, or the like.

The lid 12 and the wipe access door 14 may also include a resilient wipe access door seal 102 and corresponding abutment surface 104 which projects away from the wipe access door 14. The resilient wipe access door seal 102 may be over-molded in a similar fashion to the resilient lid seal 106. The resilient wipe access door seal 102 may be in the form of a ring surrounding the wipe access opening 15, which engages the abutment surface 104 when the wipe access door is in a closed position in order to prevent fluid communication of air between the inside compartment 16 and the outside environment. When the wipe access door 14 is closed, the abutment surface 104 slightly deforms the resilient wipe access door seal 102 to form an air-tight boundary. The resilient wipe access door seal 102 and abutment surface 104 may be formed in a variety of shapes or sizes suitable to create the air-tight connection. Furthermore, the resilient wipe access door seal 102 may be made from various materials, including those listed above for the resilient lid seal 106.

As shown in FIG. 5, the wipe access door 14 may be provided with a resilient biasing mechanism for biasing the door 14 into the open position. The resilient biasing mechanism may be a hinge spring 84. The hinge spring 84 may be constructed as a flexible, resilient member that bends and/or deflects as the wipe access door 14 moves into a closed position. The hinge spring 84 may also be a torsion spring located at an access door hinge 86, or any other suitable biasing mechanism for opening the wipe access door 14 when the push-button latch 82 releases the second latch 19.

Figure 32:
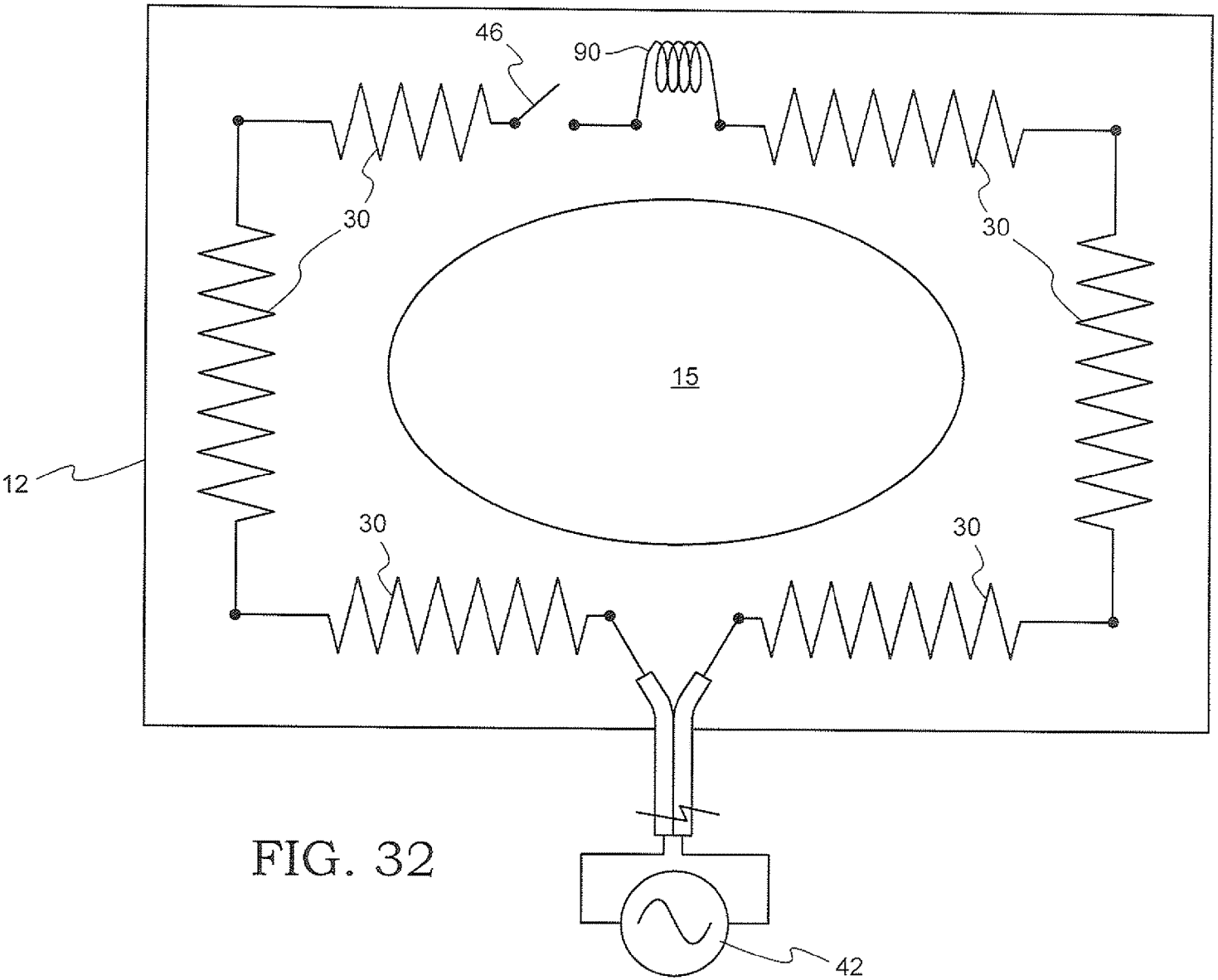
FIG. 32 shows an exemplary schematic circuit diagram for the wet wipe container.

An LED light or indicator 90 may be provided to indicate when the heating element 30 is powered, as shown and described in more detail in FIG. 32. The light 90 may be any suitable light source and may be located in the housing 11, the lid 12, the wipe access door 14, or any other location within the wet wipe container 10. The light 90 may also oscillate on and off at various frequencies to represent different temperature statuses, such as to blink when the wet wipe container 10 has reached a predetermined temperature or the like. Likewise, the light 90 may alternate between various different colors to indicate various stages of the warming process.

Figure 7:
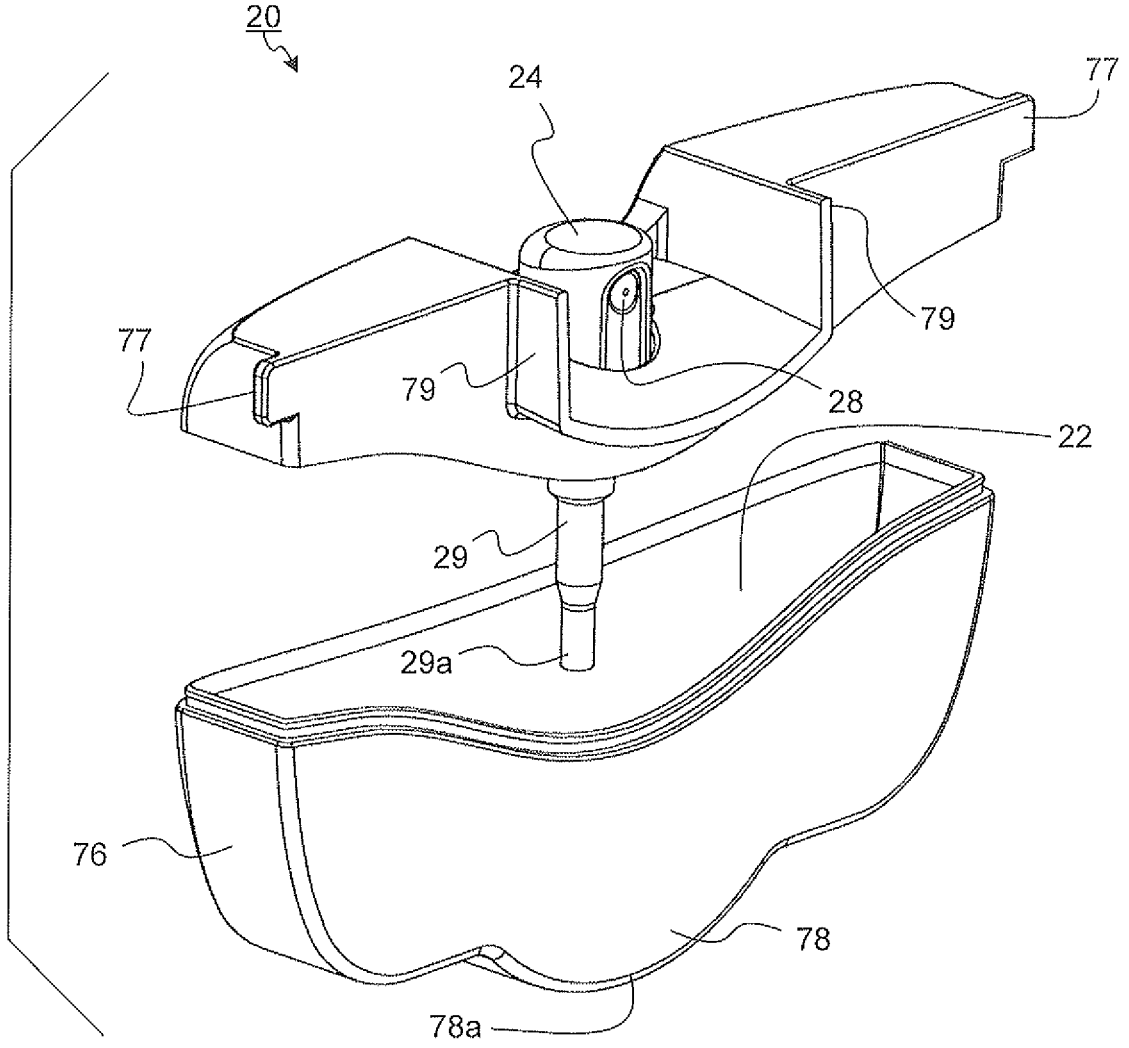
FIG. 7 shows an exploded view of the spray pump mechanism.
Figure 10:
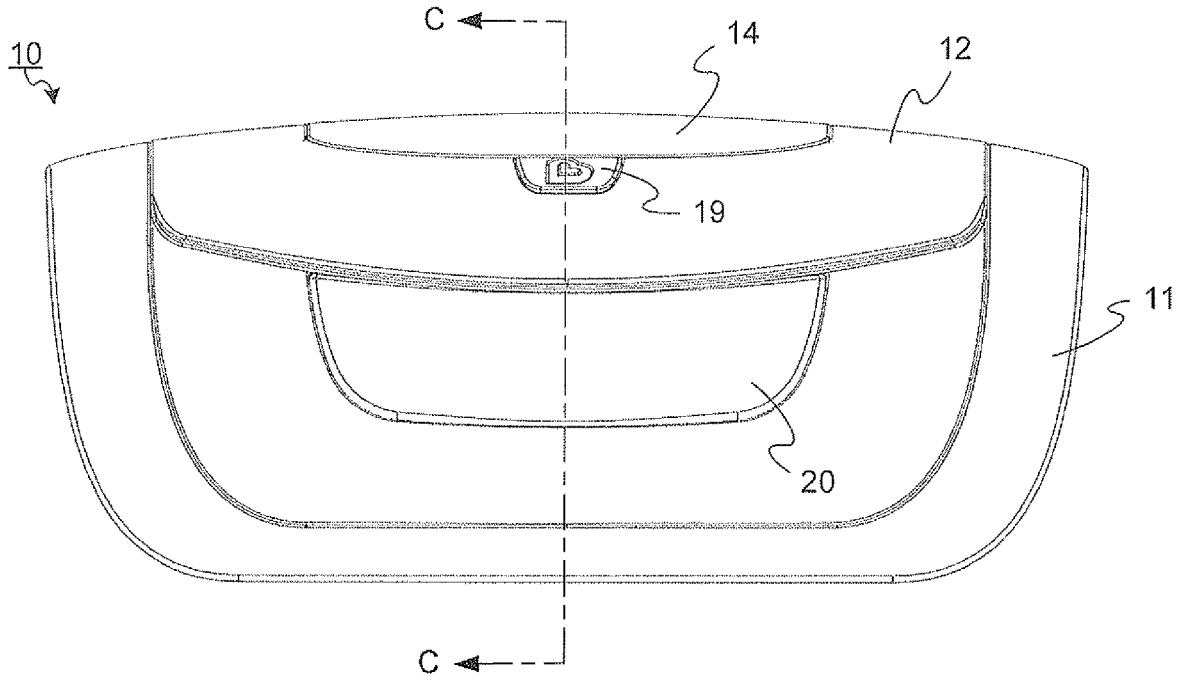
FIG. 10 depicts a front view of a first configuration for the wet wipe container, having a lid in a closed position.
Figure 11:
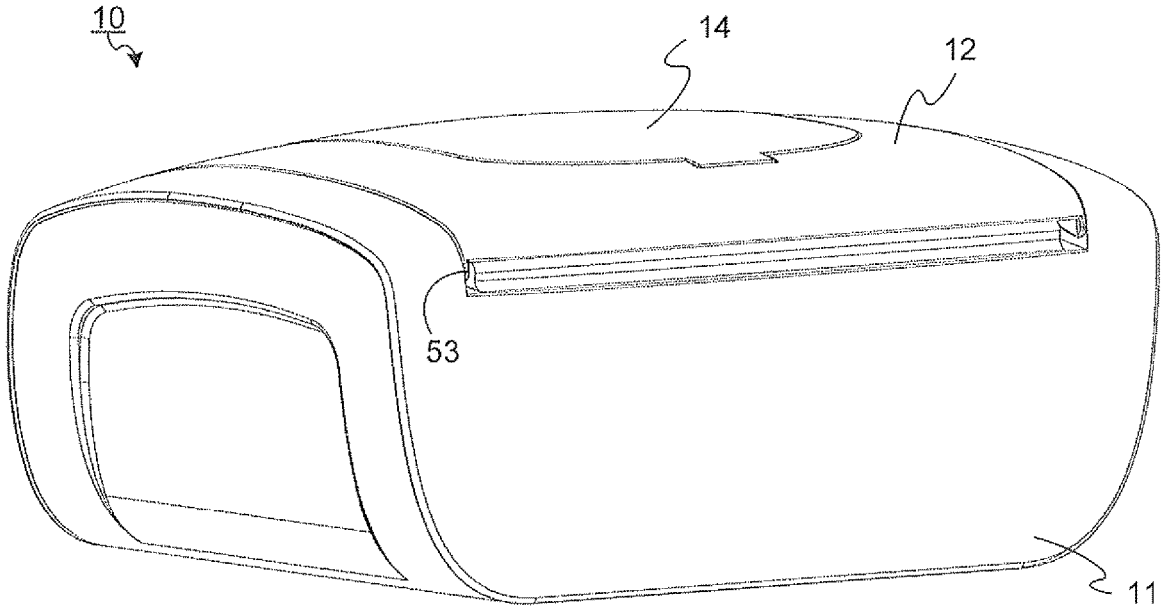
FIG. 11 shows a rear perspective view of the wet wipe container.
Figure 12:
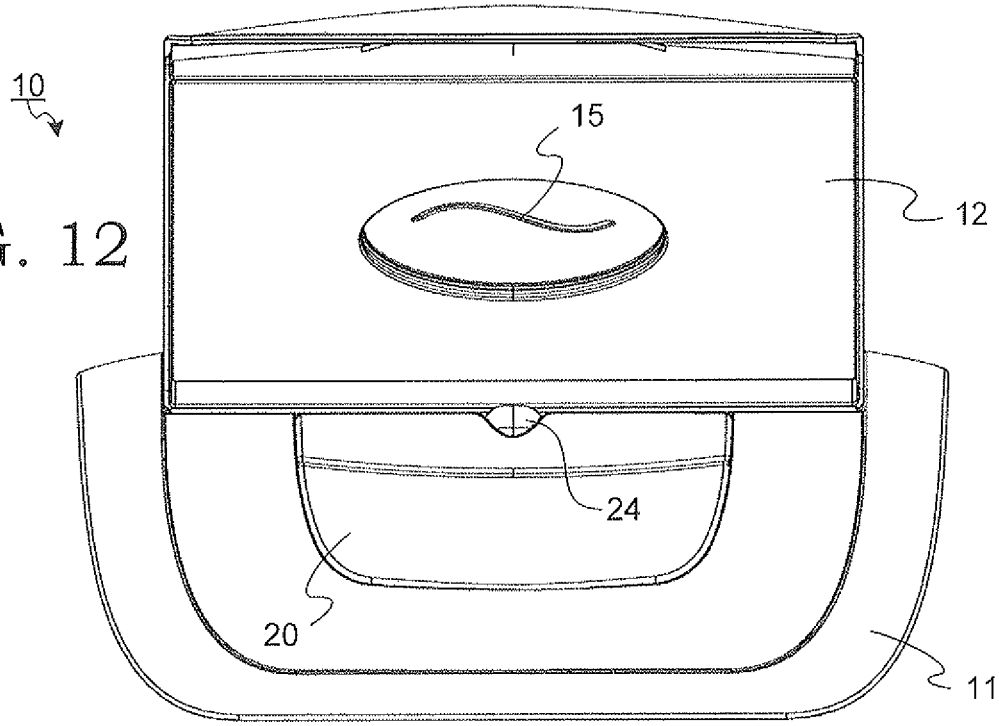
FIG. 12 illustrates a front view of the wet wipe container, having the lid in an open position.
Figure 13:
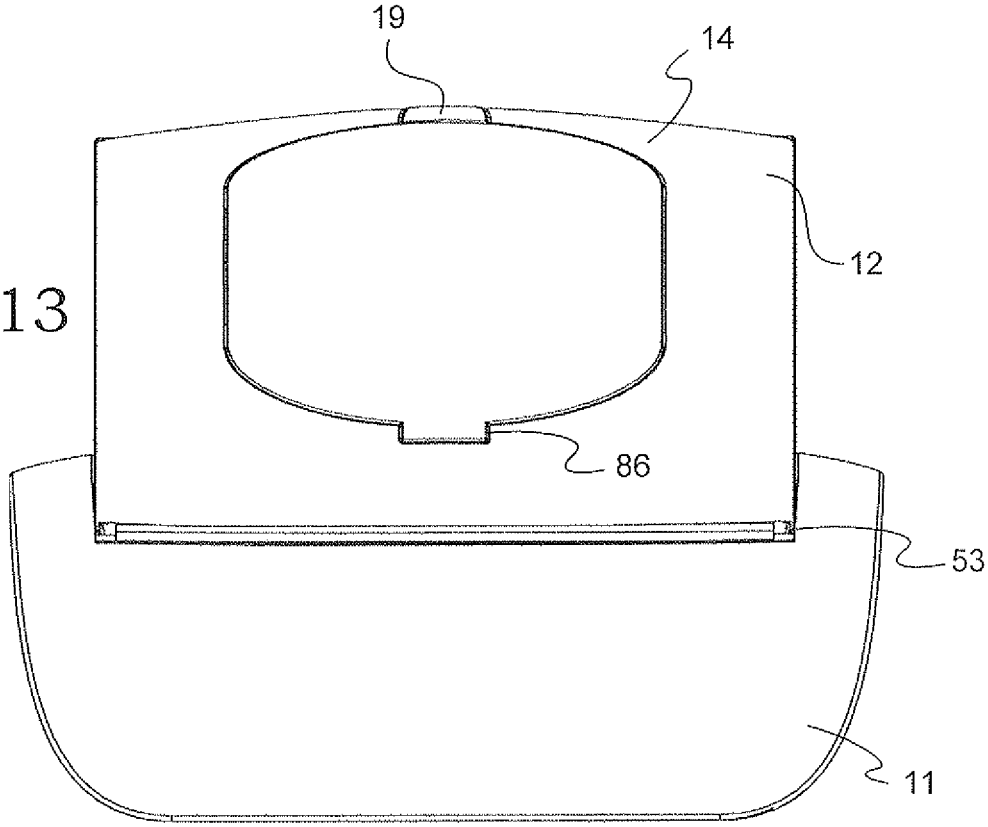
FIG. 13 depicts a rear view of the wet wipe container.
Figure 14:
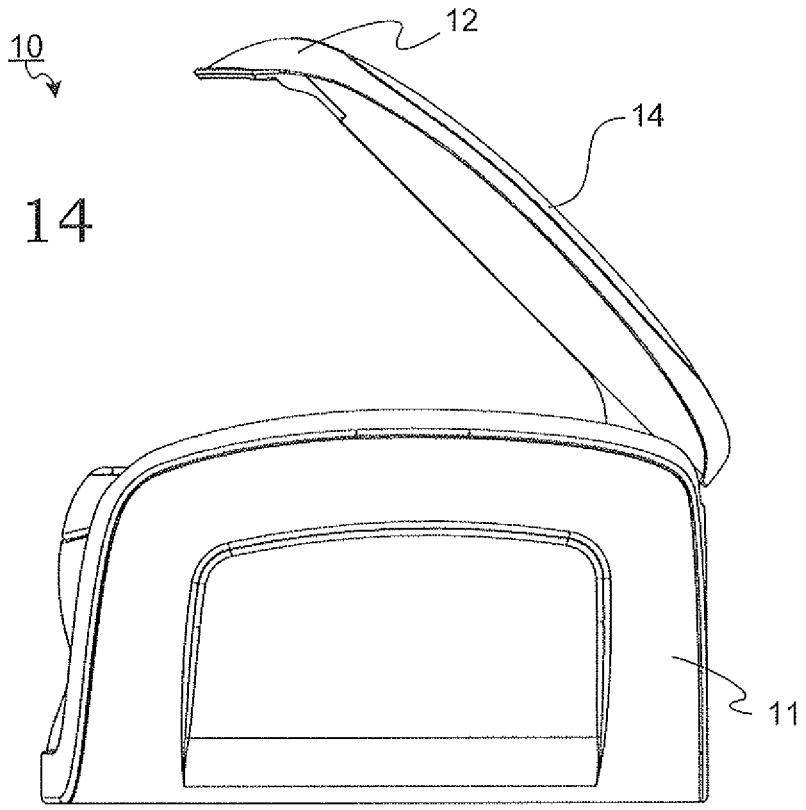
FIG. 14 shows a side view of the wet wipe container, having the lid in the open position.
Figure 15:
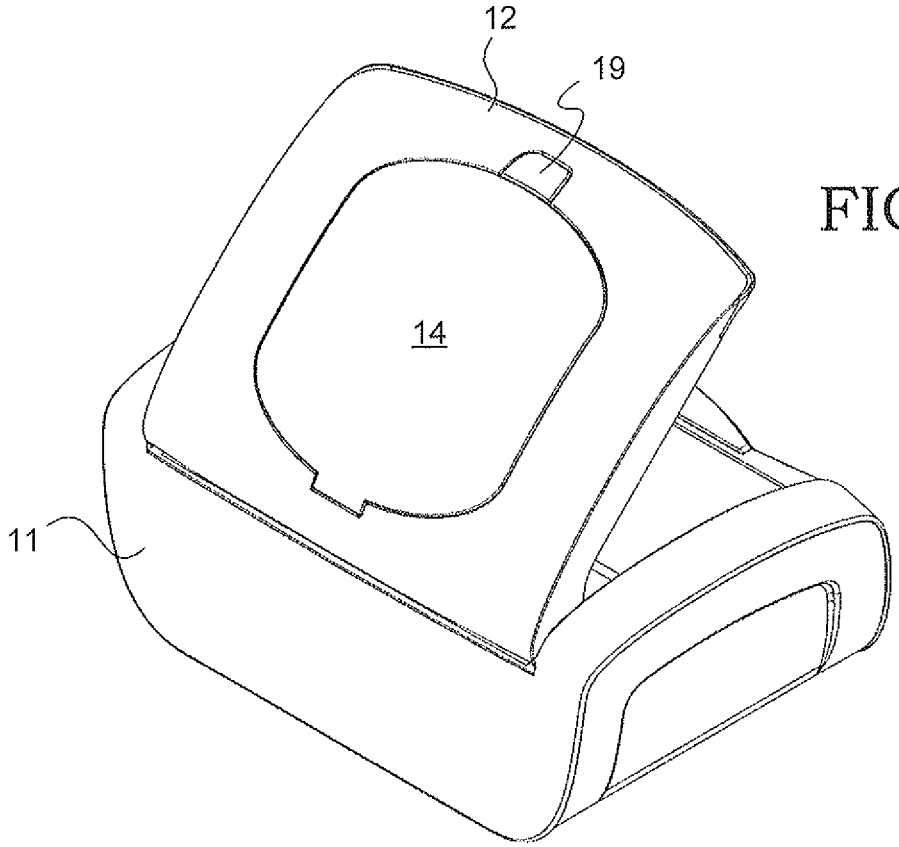
FIG. 15 illustrates a rear perspective view of the wet wipe container.
Figure 16:
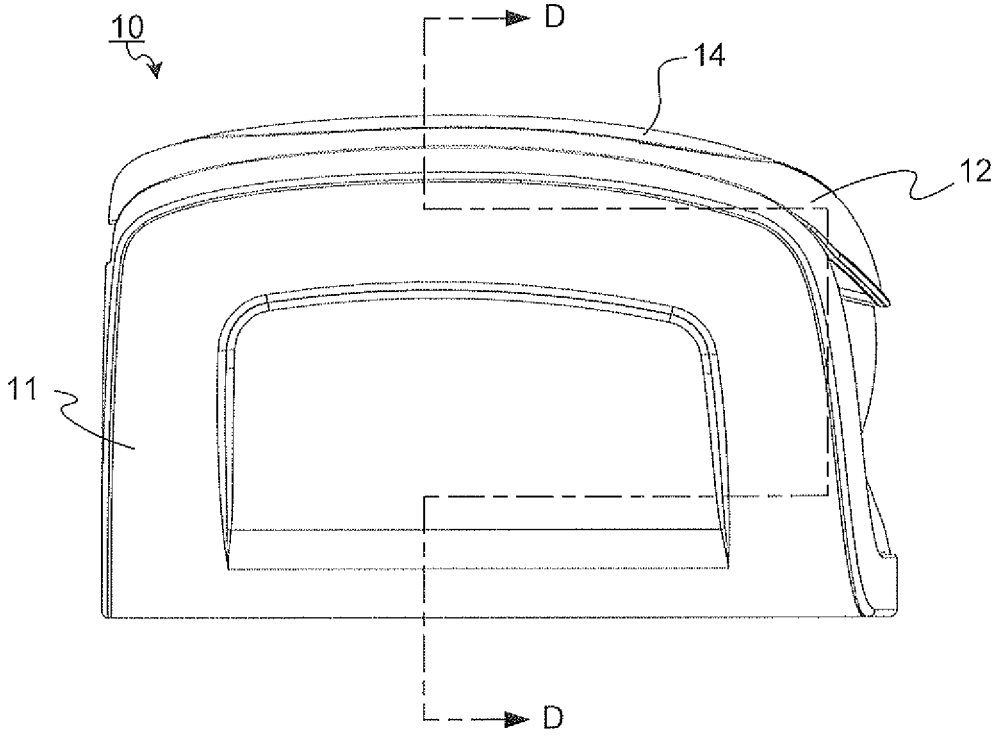
FIG. 16 depicts a side view of the wet wipe container, having the lid in the closed position.
Figure 17:
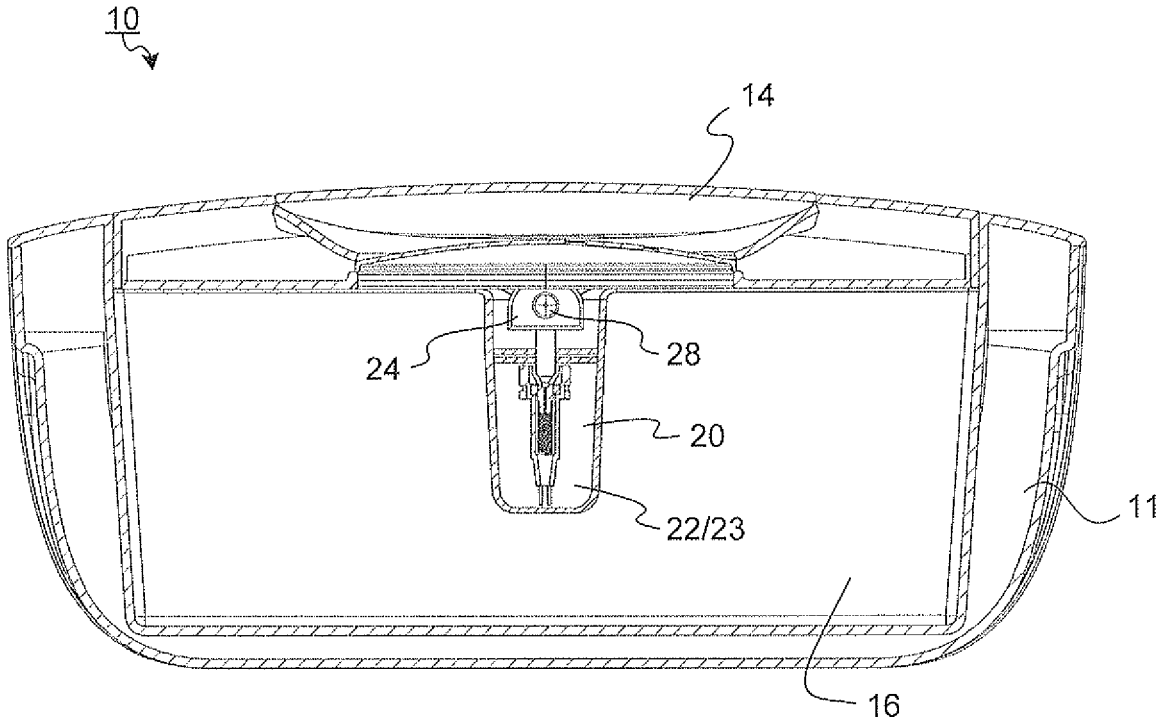
FIG. 17 shows a partial cross section view of the wet wipe container about cross section lines D-D in FIG. 16.

FIGS. 5-6 depict a cross-section view of the wet wipe container 10. An intermediate push-button 40 may be provided within the lid 12. When the wipe access door 14 is in the open position, a user may press the intermediate push-button 40 which in turn will depress the push-button 24 on the spray pump mechanism 20 and spray fluid into the internal compartment 16. Furthermore, an extending lug 25 may protrude from the wipe access door 14 which will depress the intermediate push-button 40 when the wipe access door 14 is moved into a closed position. Multiple mechanisms by which a user may depress the push-button 24 on the spray pump mechanism 20 are discussed at greater length below. The push-button 24 may also include projection or alignment tabs 24*a* (as shown in FIGS. 2 and 7) to keep the outlet 28 pointed in the direction of the stack of wipes 13 as it is dispersed.

A heating element 30 is provided within the wet wipe container 10. The heating element 30 is provided within the housing to heat the contents within the wet wipe container 10. That is, the heating element 30 may be provided to warm an internal fluid compartment 22 in the spray pump mechanism 20 and the internal wipes compartment 16. The heating element 30 may be disposed in the lid 12, the housing 11, the internal compartment 16 or in various positions in the wet wipe container 10 to achieve its warming purpose. An advantage to disposing the heating element 30 above the stack of wipes 13 is to keep the top wipe, the next wipe to be used, warm.

A heater selected from various commercially available heating elements may be used to generate and provide heating to the various elements within the wet wipe container 10. The heating element 30 may also be electronically integrated with the LED light 90 and/or a display (not shown) in order to provide the user with information regarding the temperature and status of the heating element 30.

The spray pump mechanism 20 is integrated into the housing 11 of the wet wipe container 10. The spray pump mechanism 20 includes the internal liquid compartment 22 capable of holding a fluid 23. The compartment 22 may be separated from the internal wipe housing compartment 16. The spray pump mechanism 20 is operable to draw the fluid 23 from the internal liquid compartment 22 for delivery of the moisturizing fluid to the wipes 13 stored in the wipe housing compartment 16. In this manner, the compartment 22 may be disposed outside of the housing 11 such that the fluid 23 is drawn through the outlet 28 and delivered directly to the wipes 13 stored within the compartment 16.

As shown in detail in FIGS. 5-6, a push-button 24 of the spray pump mechanism can be provided in a variety of different configurations as will be described with respect to FIGS. 5-6 and 17-19. The spray pump mechanism 20 may be electronically or mechanically actuated.

The push-button 24, as depicted in FIGS. 1 and 5-6, may be actuated in a variety of different ways. As shown in FIG. 1, the push-button 24 is exposed when the lid 12 is in the open position and may be depressed manually by the user to spray the fluid 23 onto the stack of wipes 13. As shown in FIG. 4, the user may press the intermediate push-button 40 to actuate the push-button 24. In addition, as shown in FIG. 6, the extending lug 25 of the wipe access door 14 may depress the intermediate push-button 40 which in turn actuates the push-button 24.

As shown in FIG. 6, when the wipe access door 14 is depressed, the extending lug 25 presses against the intermediate push-button 40, which presses against the push-button 24 thereby drawing fluid 23 from the fluid compartment 22 into a fluid channel 26 in the push-button 24 and dispersing a moistening spray 27 from an outlet nozzle 28 in the head of the push-button 24. When the wipe access door 14 is in a closed position, the push-button 24 will remain depressed until the wipe access door 14 is opened again. In an alternative configuration, the spray pump mechanism 20 can be constructed to dispense a moistening spray 27, when the depressed push-button 24 is released from its depressed position.

The outlet nozzle 28 disposed in the push-button 24 of the spray pump mechanism 20 is configured to project the fluid spray 27 directly into the housing compartment 16 of wet wipe container 10. The fluid spray 27 sprays directly onto and to completely cover the exposed portions of the wipes within the housing compartment 16 when the lid is in a closed position or an open position.

In operation, dispersing the moisturized fluid 27 onto the wipes assures receipt of a moist and warm wipe 13*a* when pulled from within the wet wipe warmer 10. The moisturized fluid 27 serves to provide sufficient moisture to the wipes 13 to overcome the drying out of the wet wipes 13 as a result of liquid evaporation during the heating of the various wipes 13.

FIG. 6 also depicts the hinge spring 84 in a deflected position between the wipe access door 14 and lid 12. This configuration provides the hinge spring 84 with the necessary torsion force to bias the wipe access door 14 open when the latch mechanism 19 is released by the push-button latch 82.

In addition, the wipe access opening 15 may be constructed as a thin flexible membrane 57 having a narrow slit 58. As shown in FIG. 4, when pulling a new wipe 13*a* from the stack of wipes 13 and priming the wet wipe container 10, the user may place their fingers through the narrow slit 58, slightly deflecting the thin flexible membrane 57, in order to retrieve the wipe 13*a*. When the wipe 13*a* is primed with fluid 23, it may be secured and retained within the thin flexible membrane 57 by the narrow slit 58 as shown in FIG. 6. While the heating element 30 is powered and providing heat to the internal compartment 16 and the stack of wipes 13, the wipe 13*a* may be positioned between the heating elements 30 as shown in FIG. 5.

FIG. 7 shows an exploded view of the spray pump mechanism 20. The spray pump mechanism 20 may have a descending tube 29 having an inlet 29*a*. The bottom surface 78 of the housing of the spray pump mechanism 20 may be concave such that as the fluid 23 is drained from the internal compartment 22, the fluid 23 will pool at a lowest point 78*a* at a center of the internal compartment 22. In this configuration, the inlet 29*a* which draws in the fluid 23 into the internal fluid channel 26 may be in constant fluid communication with the fluid 23 until the internal compartment 22 is completely empty.

Figure 18:
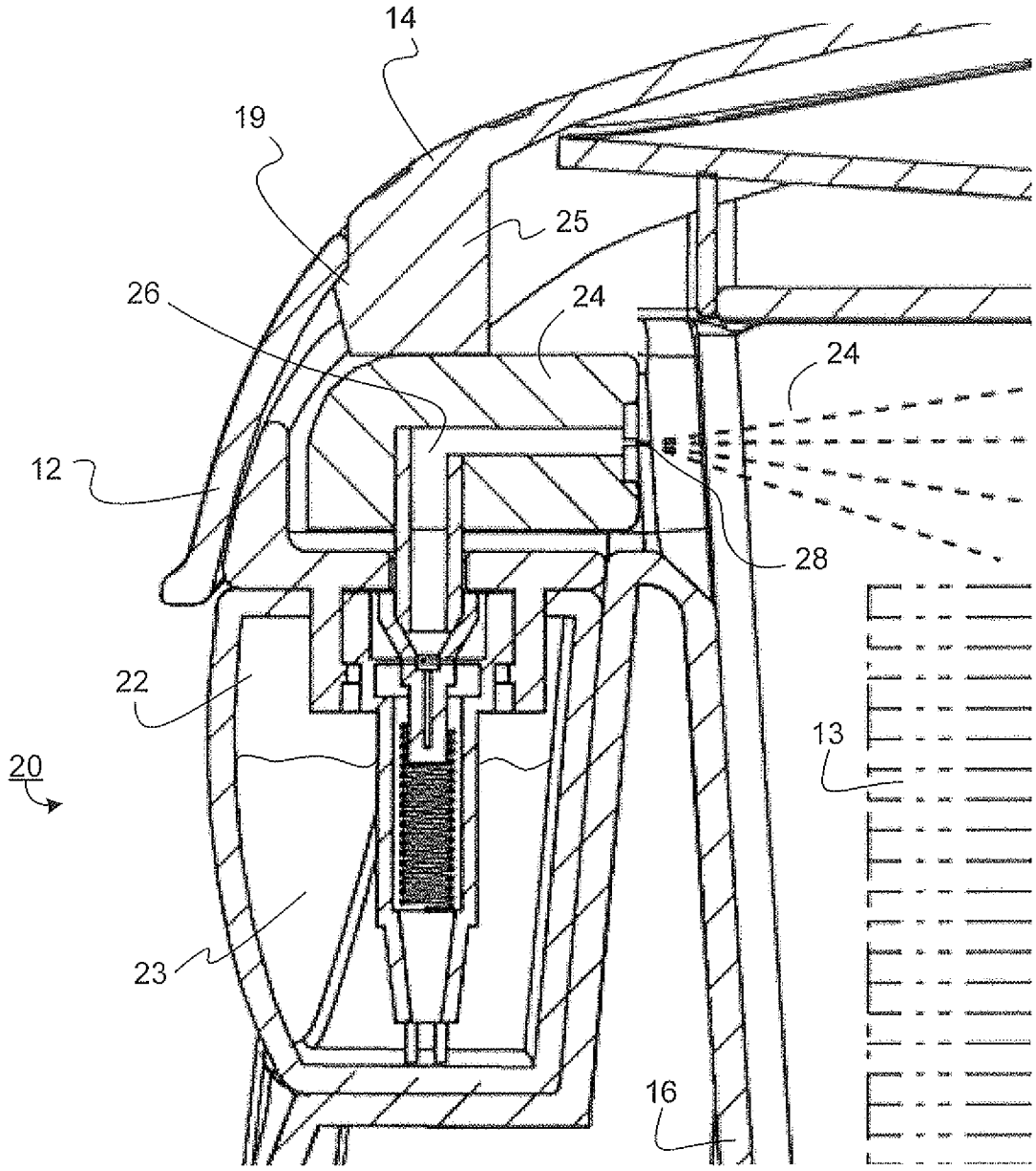
FIG. 18 illustrates an enlarged view of the pump mechanism provided in the wet wipe container.

FIGS. 8-18 show another configuration for a wet wipe container 10. In more detail in FIGS. 9 and 17-18, the push-button 24 is shown actuated in a variety of different ways. First, and as shown in FIGS. 9 and 18, the push-button 24 may be actuated by an extending lug 25 projecting from beneath the wipe access door 14. As shown in FIG. 9, when the wipe access door 14 is depressed, the extending lug 25 presses against the push-button 24 thereby drawing fluid 23 from the fluid compartment 22 into a fluid channel 26 in the push-button and dispersing a moistening spray 27 from an outlet nozzle 28 in the head of the push-button 24. In addition, the second latch 19 of the wipe access door 14 may be constructed as an integrated one-piece member of the extending lug 25.

The fluid 23 may also be dispensed when the wipe access door 14 is open. A user may wish to spray the moisturizing fluid 23 onto the wipe 13*a* when the lid 12 is opened by depressing the head of the push-button 24 during the lid 12 opening action. Similarly, the fluid 23 in the fluid compartment 22 may also be dispensed when the lid 12 is open. That is, the user may spray the moisturizing fluid 23 onto the wipe by depressing the head of the push-button 24 thereby dispensing the fluid spray 27 onto the wipes 13.

FIG. 9 shows an alternative position for the heating element 30. The heating element 30 may be located in a rear cavity 34 between the housing 11 and the inner wipe compartment 16 in order to heat the stack of wipes 13. The heating element 30 may also be located in a front cavity 36 located between the housing 11 and the inner wipe compartment 16, below the spray pump mechanism 20. In this configuration, the heating element 30 may be adjacent to both the stack of wipes 13 and the fluid 23 within the internal compartment 22 and may be provided to warm the internal fluid compartment 22 and the internal wipes compartment 16.

Figure 19:
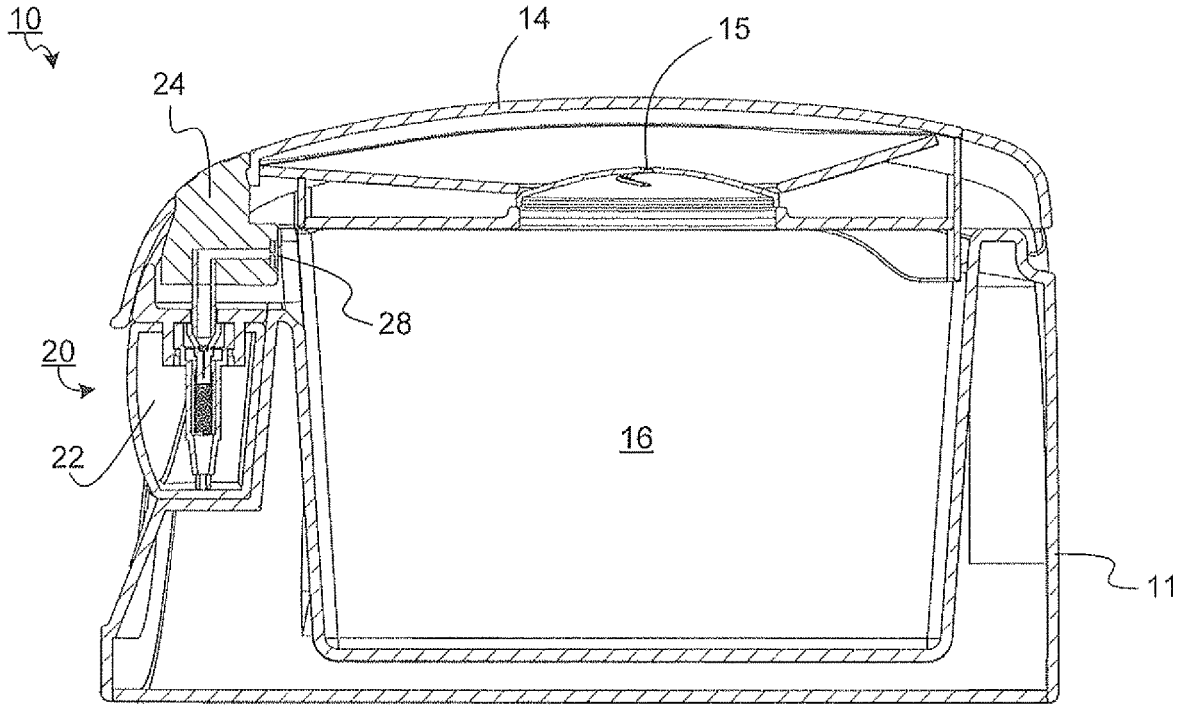
FIG. 19 depicts a third embodiment for actuating the pump mechanism in the wet wipe container.

FIG. 19 illustrates another exemplary embodiment in which the push-button 24 extends through the top of the lid 12 of the wet wipe container 10. In this way, the head of the push-button 24 may be accessed at any time whether the lid or the wipes access door 14 is open or closed as they do not interfere with access to the push-button 24. The fluid spray 27 through the push-button 24 is activated each time the elongated push-button 24 is directly depressed by a user. Furthermore, the second latch 19 may be disposed between the push-button 24 and the wipe access door 14.

Figure 20:
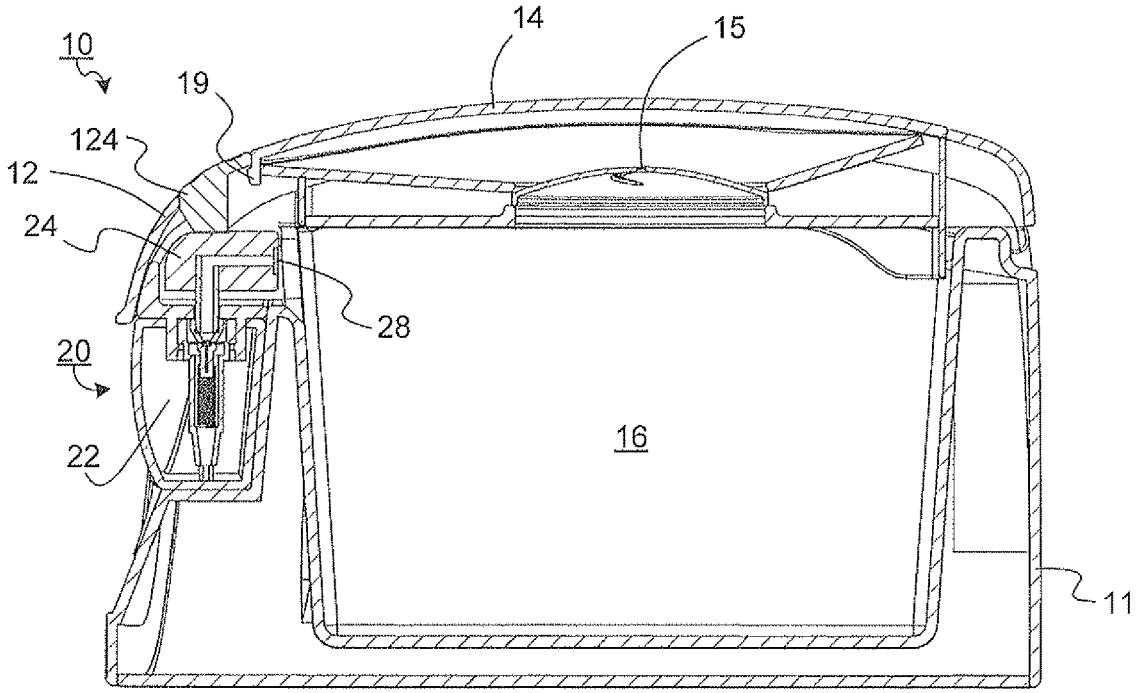
FIG. 20 shows a fourth embodiment for actuating the pump mechanism in the wet wipe container.
Figure 21:
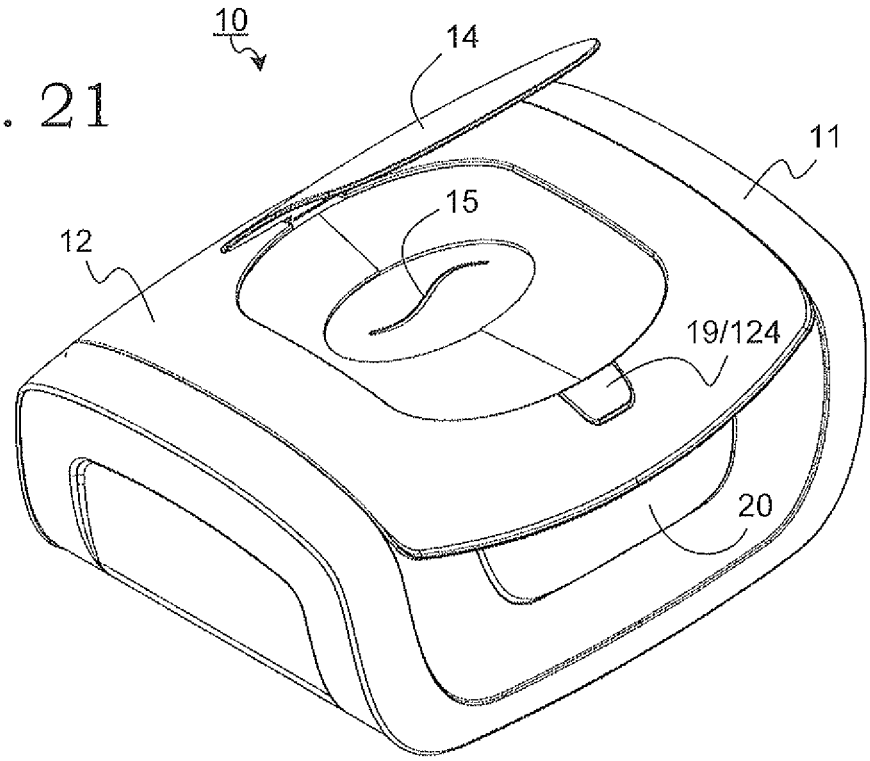
FIG. 21 depicts an upper perspective view of another configuration for the wet wipe container housing, having a wipe access door in an open position.
Figure 22:
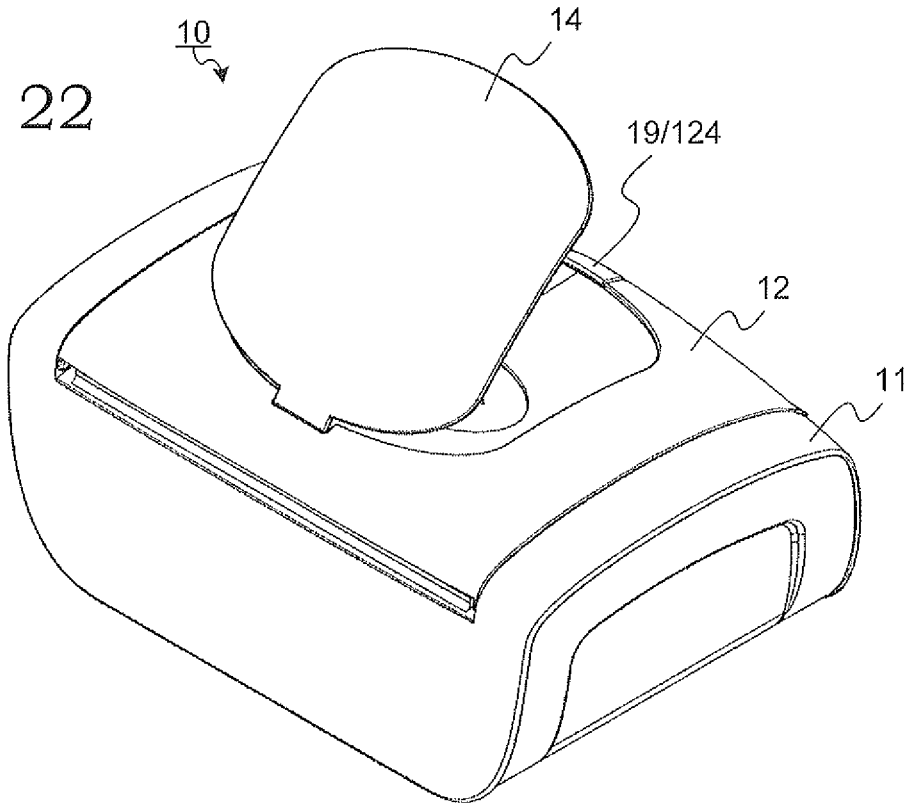
FIG. 22 illustrates a rear perspective view of the wet wipe container.
Figure 23:
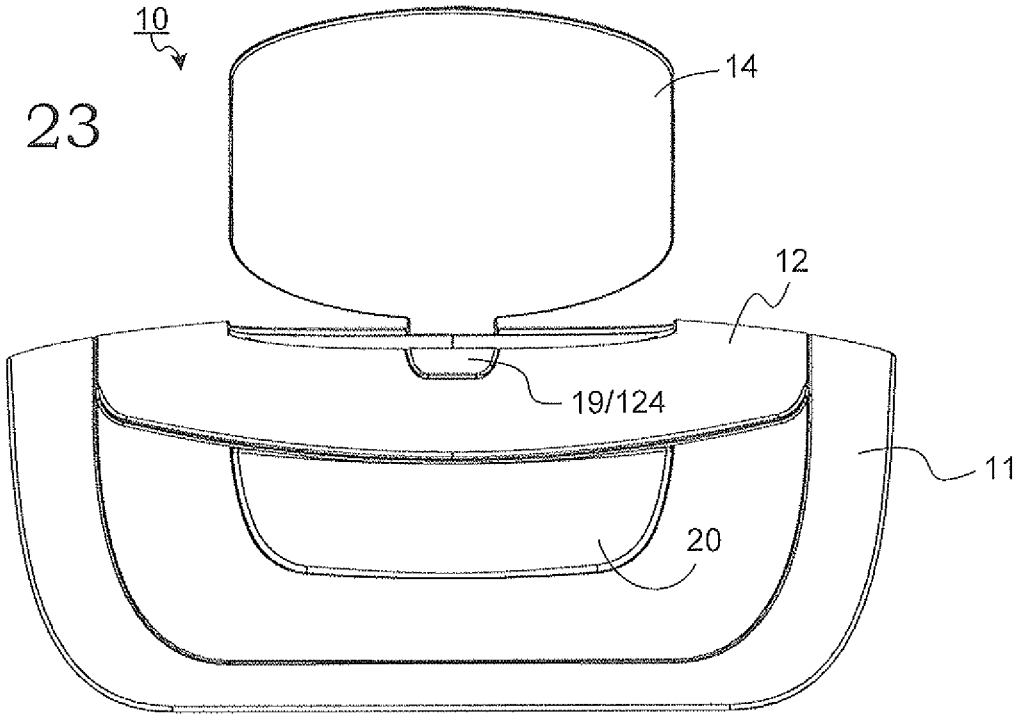
FIG. 23 shows a front view of the wet wipe container.
Figure 24:
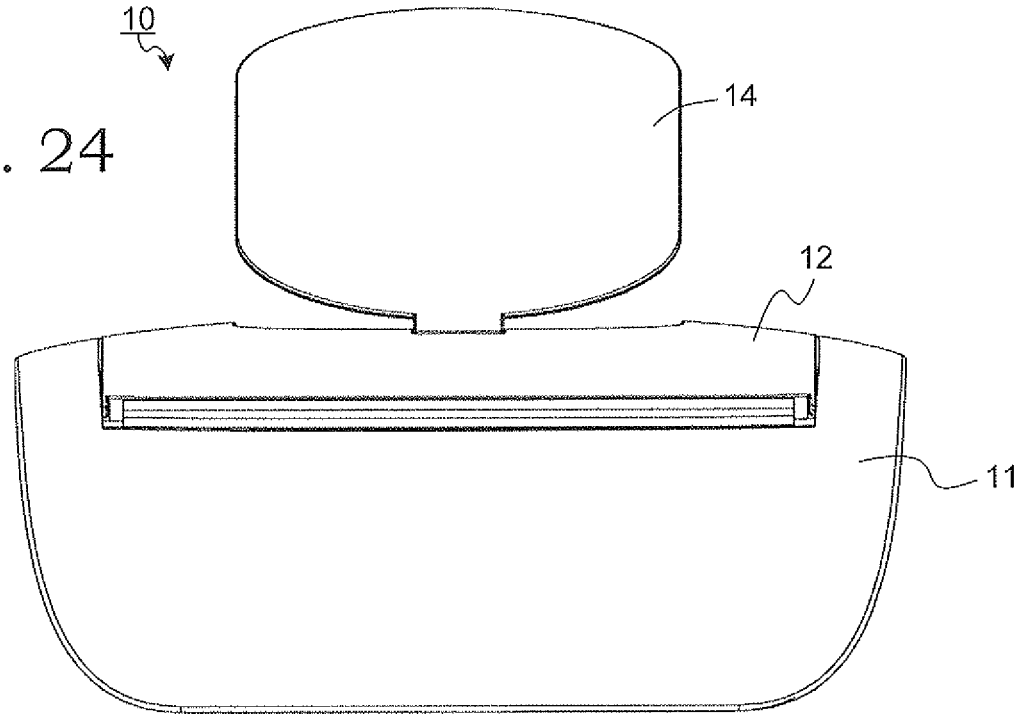
FIG. 24 depicts a rear view of the wet wipe container.
Figure 25:
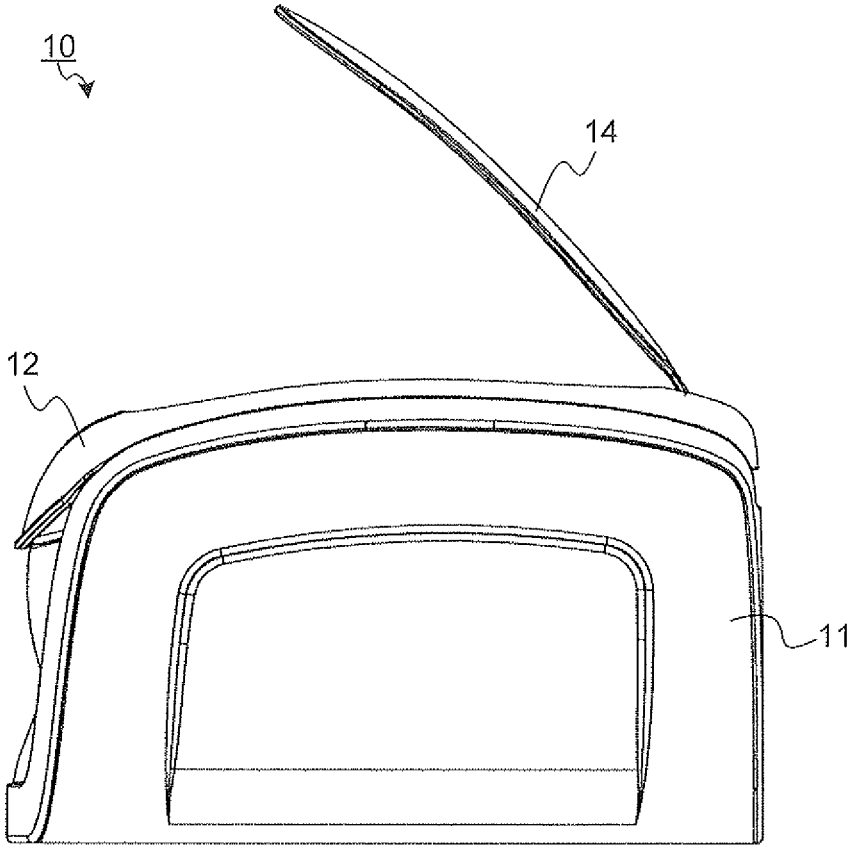
FIG. 25 illustrates a side view of the wet wipe container.
Figure 26:
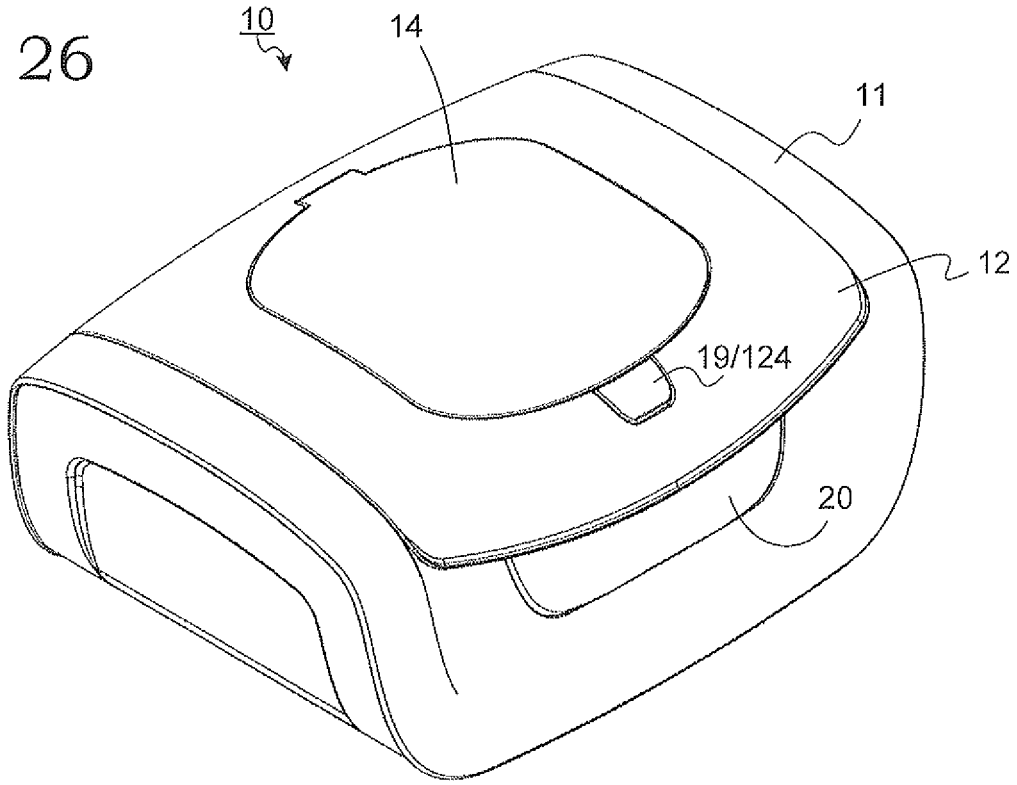
FIG. 26 shows an upper perspective view of the wet wipe container, having the wipe access door in a closed position.
Figure 27:
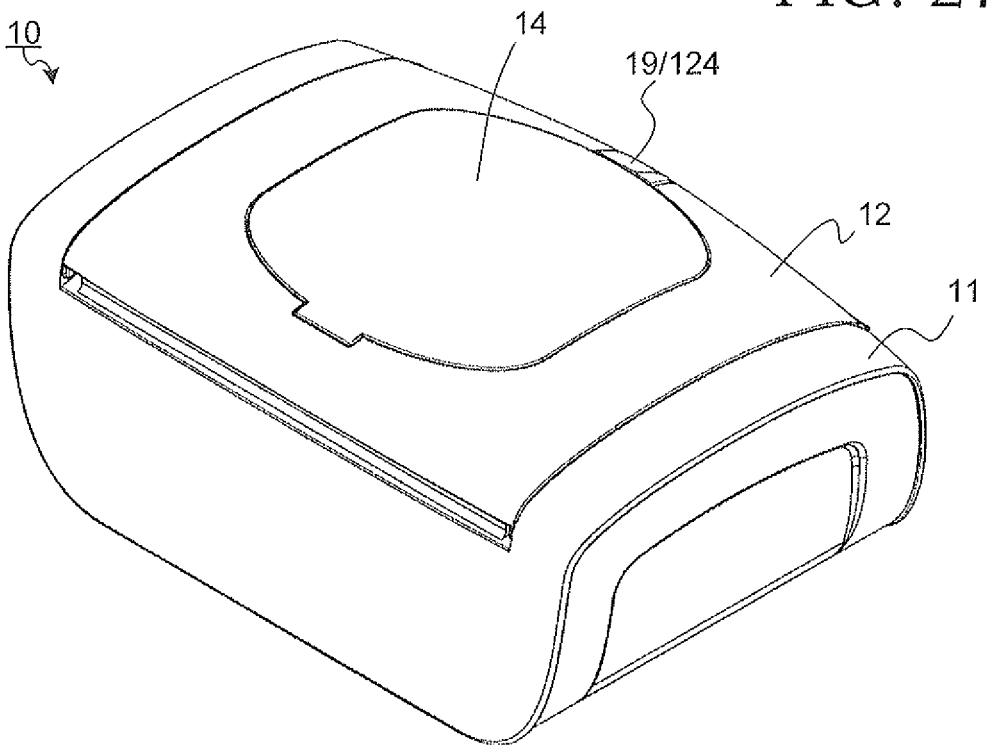
FIG. 27 depicts a rear perspective view of the wet wipe container.
Figure 28:
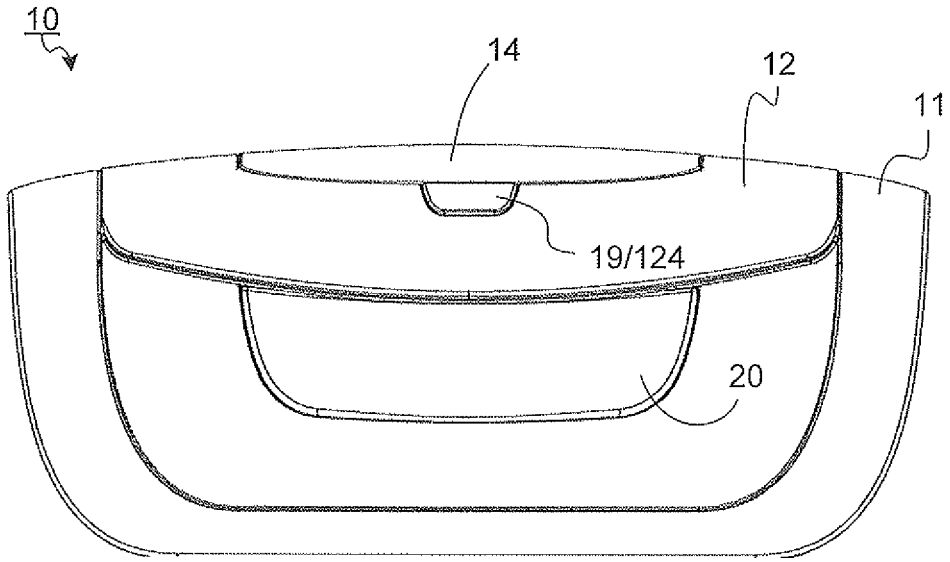
FIG. 28 illustrates a front view of the wet wipe container.
Figure 29:
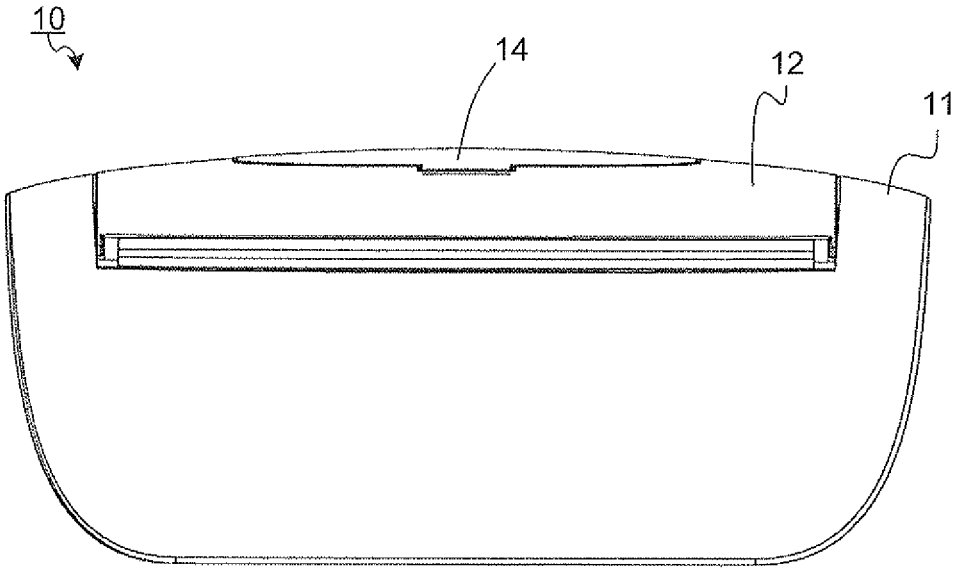
FIG. 29 shows a rear view of the wet wipe container.
Figure 30:
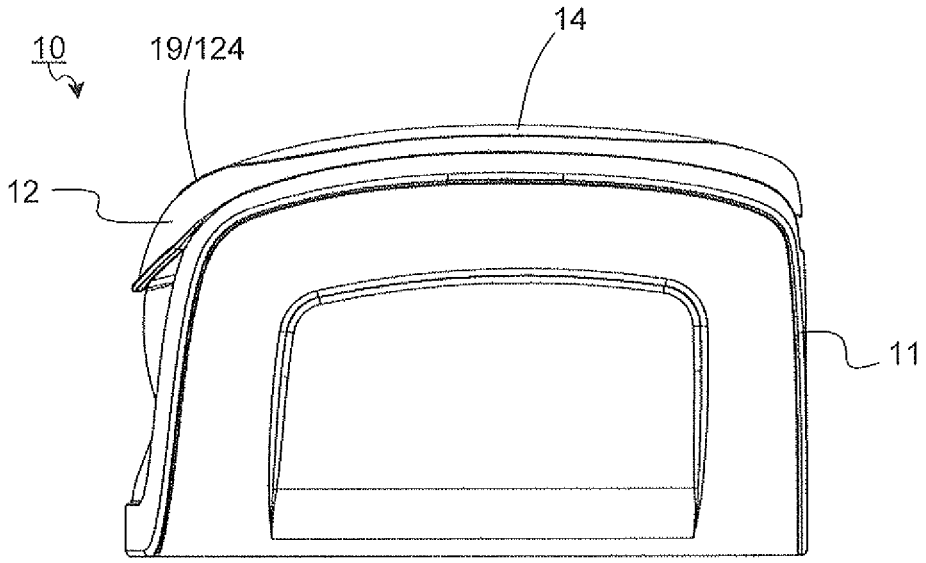
FIG. 30 depicts a side view of the wet wipe container.
Figure 31:
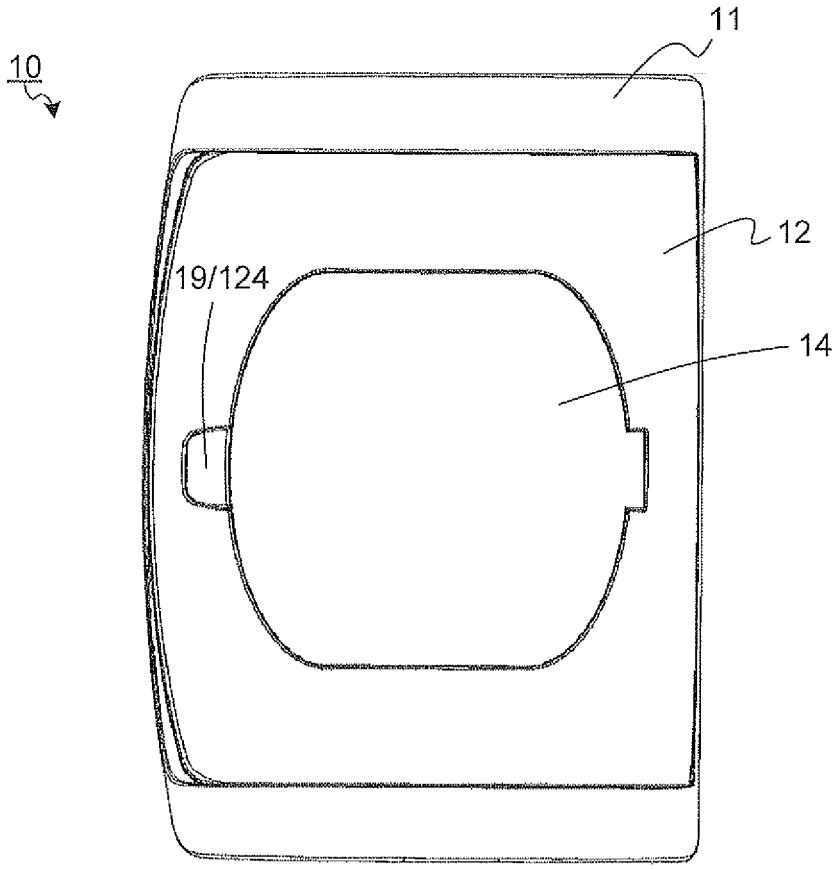
FIG. 31 illustrates a top view of the wet wipe container.

Alternatively, FIG. 20 depicts yet another exemplary embodiment in which the push-button 24 is also disposed below a second push-button 124 provided in the lid 12. In use, when the second push-button 124 is depressed, the first push-button 24 is also depressed and the fluid spray 27 is dispersed over the wipes 13 in the housing compartment 16. The second push-button 124 may be actuated when the lid and the wipes access door 14 is in a closed position. One of ordinary skill in the art would understand that a variety of different constructions is possible in which the head of the push-button 24 may be directly or indirectly depressed to dispense the liquid fluid 27 onto the various wipes 13.

FIGS. 21-31 depict another exemplary configuration for the wet wipe container housing as previously illustrated and described in FIGS. 19-20. In particular, FIGS. 21-25 show various views of the lid 12 closed and the wipe access door 14 opened so that the wipes 13 may be accessed through the wipe access opening 15. FIGS. 26-31 show various views of the lid 12 and wipe access door 14 closed and the combined second latch 19 and second push-button 124. As shown, the second push-button 124 is accessible and may be depressed so that the fluid spray 27 may be dispersed over the wipes 13 in the housing compartment 16 while the lid 12 and wipe access door 14 closed.

FIG. 32 illustrates a schematic diagram of the heating elements 30. The schematic diagram is shown for exemplary purposes. It is to be understood that other suitable configurations may be used in accordance with this subject disclosure. A power source 42 may supply electricity to the heating elements 30, which radiates heat from the electricity passing through resistive material such as suitable metals, ceramics, composites, or other combinations. Power source 42 can be alternating current (AC) or direct current (DC) driven.

A switch 46 may be provided to actuate the heating elements 30. The switch 46 may be located on the wipe access door 14, the lid 12, the housing 11 or any other suitable location on the wet wipe container 10, at any location within the schematic diagram for altering the current flowing through the heating elements 30. FIG. 32 shows the heating elements 30 disposed within the lid 12, around the wipe access opening 15. The switch 46 may be a single button switch 46 which cycles though various stages of the warming process, or a multi-button panel 46 which may include a display (not shown) for displaying various information about the wet wipe container. Additionally, the heating elements 30 may be actuated upon plugging the wet wipe container 10 into the power source 42.

The heating elements 30 may also be connected to the LED light or indicator 90. As previously discussed, the LED light 90 may be provided to indicate when the heating element 30 is powered, or oscillate on and off at various frequencies to represent different temperature statuses. Furthermore, the LED light 90 may be integrated into the switch 46, such that the LED light 90 either protrudes from the switch 46 or may be seen through the switch 46.

The wet wipe container 10 can be embodied in a variety of different sizes, shapes and configurations. The details and functionality of each of the various components are interchangeable and carry throughout the various embodiments. The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A wet wipe container, the wet wipe container comprising:

a wet wipe housing having a peripheral wall with a recess, a bottom portion, a top portion forming an internal compartment for containing wet wipes, and an electric heating element;

a lid connected to the housing at the top portion; and a spray dispenser having an exit aperture of an outlet positioned by an opening in the peripheral wall of the internal compartment housing the wet wipes to dispense a fluid through the recess in the peripheral wall and directly onto the wet wipes to completely cover exposed portions of the wet wipes in a storage position in the housing.

2. The wet wipe container recited in claim 1, wherein the wet wipes housing has an internal recess adapted to securely receive the spray dispenser.

3. The wet wipe container recited in claim 2, wherein the internal recess of the wet wipes housing has at least one alignment feature for receiving and securing the spray dispenser.

4. The wet wipe container recited in claim 1, further comprising a heater in the wet wipe housing or the lid to facilitate warming the wet wipes.

5. The wet wipe container recited in claim 1, wherein the lid has a dispensing opening through which at least one wipe is dispensed and the dispensing system further comprises a dispensing lid.

6. The wet wipe container recited in claim 5, wherein the spray dispenser has a push-button actuator for dispensing the fluid.

7. The wet wipe container recited in claim 6, further comprising an intermediate push-button in contact with the push-button actuator, the intermediate push-button being accessible when the lid or the dispensing lid is in a closed position.

8. The wet wipe container recited in claim 7, wherein the dispensing lid has an extending lug which depresses the intermediate push-button or spray dispenser when the dispensing lid is in a closed position.

9. The wet wipe container recited in claim 6, wherein the push-button actuator is accessible when the lid is in a closed position.

10. The wet wipe container recited in claim 9, wherein the dispensing lid has an extending lug which depresses the push-button actuator when the dispensing lid is in a closed position.

11. The wet wipe container recited in claim 9, wherein the push-button actuator is accessible when the dispensing lid is in a closed position.

12. The wet wipe container recited in claim 1, wherein the top surface of the wet wipes includes an exposed portion of the wet wipes within the housing when the lid is in an open or closed position.

13. A wet wipe container system comprising:

a wet wipe housing having a peripheral wall with a recess, a bottom portion, a top portion forming an internal compartment for containing wet wipes, and an electric heating element;

a lid connected to the wet wipe housing having a wipe access opening;

a wipe access door adapted to cover the wipe access opening when in a closed position; and a spray pump mechanism having an actuator, and an exit aperture of an outlet positioned in the peripheral wall of the internal compartment housing the wet wipes to dispense a fluid through the recess in the peripheral wall and directly onto the wet wipes to completely cover exposed portions of the wet wipes in a storage position in the housing.

14. The wet wipe container system recited in claim 13, wherein the spray pump mechanism is secured within the wet wipe housing.

15. The wet wipe container system recited in claim 13, wherein the actuator, either directly or indirectly, may be depressed while the lid is in the closed position.

16. The wet wipe container system recited in claim 13, further comprising a first latch for securing the wipe access door in the closed position and a second latch for securing the lid to the wet wipe housing.

17. The wet wipe container system recited in claim 16, wherein the wipe access door is biased towards an open position.

18. The wet wipe container system recited in claim 16, wherein the first latch is a push-button latch.

19. A method of wetting wipes, comprising:

placing wet wipes within a container having a peripheral wall with a recess, a bottom portion, and a top portion forming an internal compartment, a lid connected to the container having a dispensing opening, and a dispensing lid adapted to cover the dispensing opening when in a closed position;

providing a spray pump mechanism having a compartment for a fluid, an actuator, and an exit aperture of an outlet positioned within the recess in the peripheral wall of the internal compartment housing the wet wipes and an electric heating element;

depressing the actuator while the lid is being closed or in a closed position; and dispensing the fluid through the recess in the peripheral wall and directly onto the wet wipes to completely cover exposed portions of the wet wipes within the internal compartment.

20. The method recited in claim 19, wherein when depressing the actuator, engaging an extending lug on the dispenser lid either directly or indirectly to depress the actuator while the lid is in the closed position.

* * * * *